US011355079B2

(12) United States Patent
Wang et al.

(10) Patent No.: US 11,355,079 B2
(45) Date of Patent: Jun. 7, 2022

(54) ARRAY SUBSTRATE, DISPLAY PANEL, DISPLAY DEVICE, AND DRIVING METHODS THEREOF

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Zhen Wang, Beijing (CN); Wenwen Qin, Beijing (CN); Mingchao Ma, Beijing (CN); Wenchao Han, Beijing (CN); Jian Sun, Beijing (CN); Yun Qiao, Beijing (CN); Jun Fan, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/153,120

(22) Filed: Jan. 20, 2021

(65) Prior Publication Data

US 2021/0142747 A1 May 13, 2021

Related U.S. Application Data

(63) Continuation of application No. 16/547,787, filed on Aug. 22, 2019, now Pat. No. 10,923,054.

(30) Foreign Application Priority Data

Jan. 2, 2019 (CN) ..... 201910002793.3

(51) Int. Cl.
*G09G 5/02* (2006.01)
*G09G 3/36* (2006.01)

(52) U.S. Cl.
CPC ..... *G09G 3/3607* (2013.01); *G09G 3/3614* (2013.01); *G09G 2300/0452* (2013.01);
(Continued)

(58) Field of Classification Search
CPC ..... G09G 3/3607; G09G 3/3614; G09G 2300/0452; G09G 2310/0202;
(Continued)

(56) References Cited

U.S. PATENT DOCUMENTS

2011/0175858 A1 7/2011 Lee et al.
2017/0069243 A1 3/2017 Guo et al.
(Continued)

FOREIGN PATENT DOCUMENTS

CN 103714871 4/2014
CN 104766564 7/2015
(Continued)

OTHER PUBLICATIONS

Chinese Patent Office Action dated Oct. 16, 2020, in corresponding to Chinese Patent Application No. 201910002793.3. 22 pages.

*Primary Examiner* — Adam R. Giesy
(74) *Attorney, Agent, or Firm* — Leason Ellis LLP

(57) ABSTRACT

An array substrate, a display panel, a display device, and driving methods thereof are provided. The array substrate includes subpixels arranged in an array, and switches. The subpixels include subpixels of a first color, subpixels of a second color, subpixels of a third color, subpixels of a fourth color, in odd rows of subpixels, the subpixels of the first color, the subpixels of the second color, the subpixels of the third color, the subpixels of the fourth color are sequentially arranged; in even rows of subpixels, the subpixels of the third color, the subpixels of the fourth color, the subpixels of the first color, the subpixels of the second color are sequentially arranged; and the subpixels of the first color are white
(Continued)

subpixels; the subpixels of the second color are blue subpixels; the subpixels of the third color are green subpixels; the subpixels of the fourth color are red subpixels.

14 Claims, 5 Drawing Sheets

(52) U.S. Cl.
CPC ..... *G09G 2310/0202* (2013.01); *G09G 2320/0233* (2013.01)

(58) Field of Classification Search
CPC ... G09G 2320/0233; G09G 2300/0426; G09G 2310/0297; G09G 3/3648; G02F 1/1362
See application file for complete search history.

(56) References Cited

U.S. PATENT DOCUMENTS

| | | | |
|---|---|---|---|
| 2017/0193926 | A1 | 7/2017 | De Greef |
| 2020/0013355 | A1 | 1/2020 | Han et al. |
| 2020/0105178 | A1 | 4/2020 | Han et al. |

FOREIGN PATENT DOCUMENTS

| | | |
|---|---|---|
| CN | 106710502 | 5/2017 |
| CN | 108198539 | 6/2018 |
| CN | 108803174 | 11/2018 |
| CN | 108877641 | 11/2018 |
| WO | 2018221478 | 12/2018 |

ARRAY SUBSTRATE, DISPLAY PANEL, DISPLAY DEVICE, AND DRIVING METHODS THEREOF

CROSS REFERENCE TO RELATED APPLICATIONS

The present application is a Continuation application of U.S. application Ser. No. 16/547,787, which claims the benefits of the Chinese Patent Application No. 201910002793.3 filed on Jan. 2, 2019 and entitled 'AN ARRAY SUBSTRATE, A DISPLAY PANEL AND A DRIVING METHOD THEREOF', the entire contents of which are incorporated herein by reference for all purpose.

TECHNICAL FIELD

Embodiments of the present disclosure relate to an array substrate, a display panel and a display device comprising the same, and driving methods thereof.

BACKGROUND

Liquid crystal display (LCD) has advantages of low radiation, small volume, low energy consumption and the like and is widely applied in electronic products, such as tablet PCs, TVs and mobile phones.

To decrease the amount of data driver ICs used by the LCD, multiplexer technology can be selected.

SUMMARY

At least one embodiment of the present disclosure provides an array substrate, comprising a plurality of subpixels arranged in an array, a plurality of data lines, and a plurality of switches. The plurality of subpixels include subpixels of a first color, subpixels of a second color, subpixels of a third color, and subpixels of a fourth color, in odd rows of subpixels, the subpixels of the first color, the subpixels of the second color, the subpixels of the third color, and the subpixels of the fourth color are sequentially arranged; in even rows of subpixels, the subpixels of the third color, the subpixels of the fourth color, the subpixels of the first color, and the subpixels of the second color are sequentially arranged; and each column of subpixels corresponds to and is connected with a data line; one end of each data line is electrically connected with a source electrode of a switch; and a drain electrode of the switch is configured to receive data signals.

For example, the plurality of subpixels are divided into a plurality of subpixel groups; each subpixel group includes four adjacent columns of subpixels; each column of subpixels only belong to one subpixel group; the plurality of switches include a plurality of first switches, a plurality of second switches, a plurality of third switches, and a plurality of fourth switches; in each subpixel group, a source electrode of the first switch is electrically connected with the data line corresponding to the first column of subpixels; a gate electrode of the first switch is electrically connected with a first switch control line; a source electrode of the second switch is electrically connected with the data line corresponding to the second column of subpixels; a gate electrode of the second switch is electrically connected with a second switch control line; a source electrode of the third switch is electrically connected with the data line corresponding to the third column of subpixels; a gate electrode of the third switch is electrically connected with a third switch control line; a source electrode of the fourth switch is electrically connected with the data line corresponding to the fourth column of subpixels; and a gate electrode of the fourth switch is electrically connected with a fourth switch control line.

For example, the array substrate further comprises first data terminals and second data terminals. The first data terminals and the second data terminals are electrically connected with drain electrodes of the switches, respectively; the subpixel groups include a first subpixel group and a second subpixel group; the subpixel group in the odd column is the first subpixel group, and the subpixel group in the even column is the second subpixel group; the first data terminal is configured to input first data signals into data lines corresponding to odd columns of subpixels in the first subpixel group and even columns of subpixels in the second subpixel group; or the second data terminal is configured to input second data signals into data lines corresponding to even columns of subpixels in the first subpixel group and odd columns of subpixels in the second subpixel group; and the first data signals and the second data signals are data signals with opposite polarities. For example, the array substrate further comprises a display area and a peripheral area at the periphery of the display area; the plurality of subpixels are disposed in the display area; and the switches, the first switch control line, the second switch control line, the third switch control line, the fourth switch control line, the first data terminals, and the second data terminals are disposed in the peripheral area.

For example, each subpixel includes a thin-film transistor (TFT) and a pixel electrode; a drain electrode of the TFT is electrically connected with the pixel electrode; and the switch and the TFT are arranged in a same layer.

For example, the subpixels of the first color are white subpixels; the subpixels of the second color are blue subpixels; the subpixels of the third color are green subpixels; and the subpixels of the fourth color are red subpixels.

At least one embodiment of the present disclosure also provides a display panel, comprising the array substrate.

At least one embodiment of the present disclosure also provides a method of driving the display panel. The array substrate includes a plurality of gate lines; each row of subpixels corresponds to and is connected with a gate line; and the driving method comprises: when a preset image is displayed in the case of inputting scanning signals into the gate lines, inputting data signals into the plurality of data lines according to a preset sequence, so that brightness of the subpixels of the same color in any two adjacent rows of subpixels is the same during the preset image is displayed. The preset image is an image displayed when at least inputting the data signals into data lines corresponding to subpixels of one color and at most inputting the data signals into data lines corresponding to subpixels of three colors.

For example, the subpixels of the first color are white subpixels; the subpixels of the second color are blue subpixels; the subpixels of the third color are green subpixels; and the subpixels of the fourth color are red subpixels.

For example, data signals inputted into data lines corresponding to odd columns of subpixels in each first subpixel group and even columns of subpixels in each second subpixel group are positive; and data signals inputted into data lines corresponding to even columns of subpixels in each first subpixel group and odd columns of subpixels in each second subpixel group are negative.

For example, in the case of inputting scanning signals into the gate lines corresponding to any row of subpixels, the preset sequence is: sequentially inputting data signals into data lines corresponding to the second column of subpixels, the first column of subpixels, the third column of subpixels, and the fourth column of subpixels in each subpixel group, and at a same time period, the data signals are inputted into only the data line corresponding to one column of subpixels in each subpixel group; or in the case of inputting scanning signals into the gate lines corresponding to any row of subpixels, the preset sequence is: sequentially inputting the data signals into data lines corresponding to the third column of subpixels, the second column of subpixels, the fourth column of subpixels, and the first column of subpixels in each subpixel group, and at a same time period, the data signals are inputted into only the data line corresponding to one column of subpixels in each subpixel group; or in the case of inputting scanning signals into the gate lines corresponding to odd rows of subpixels, the data signals are sequentially inputted into data lines corresponding to the second column of subpixels, the first column of subpixels, the third column of subpixels, and the fourth column of subpixels in each subpixel group; in the case of inputting scanning signals into the gate lines corresponding to even rows of subpixels, the data signals are sequentially inputted into data lines corresponding to the second column of subpixels, the third column of subpixels, the first column of subpixels, and the fourth column of subpixels in each subpixel group, and at a same time period, the data signals are inputted into only the data line corresponding to one column of subpixels in each subpixel group; or in the case of inputting scanning signals into the gate lines corresponding to odd rows of subpixels, the data signals are sequentially inputted into data lines corresponding to the second column of subpixels, the fourth column of subpixels, the third column of subpixels, and the first column of subpixels in each subpixel group; and in the case of inputting scanning signals into the gate lines corresponding to even rows of subpixels, the data signals are sequentially inputted into data lines corresponding to the second column of subpixels, the third column of subpixels, the fourth column of subpixels, and the first column of subpixels in each subpixel group, and at a same time period, the data signals are inputted into only the data line corresponding to one column of subpixels in each subpixel group.

At least one embodiment of the present disclosure also provides a display device, comprising the display panel.

At least one embodiment of the present disclosure also provides a method of driving the display device. The array substrate includes a plurality of gate lines; each row of subpixels corresponds to and is connected with a gate line; and the driving method comprises: when a preset image is displayed in the case of inputting scanning signals into the gate lines, inputting data signals into the plurality of data lines according to a preset sequence, so that brightness of the subpixels of the same color in any two adjacent rows of subpixels is the same during the preset image is displayed. The preset image is an image displayed when at least inputting the data signals into data lines corresponding to subpixels of one color and at most inputting the data signals into data lines corresponding to subpixels of three colors.

For example, the subpixels of the first color are white subpixels; the subpixels of the second color are blue subpixels; the subpixels of the third color are green subpixels; and the subpixels of the fourth color are red subpixels.

For example, data signals inputted into data lines corresponding to odd columns of subpixels in each first subpixel group and even columns of subpixels in each second subpixel group are positive; and data signals inputted into data lines corresponding to even columns of subpixels in each first subpixel group and odd columns of subpixels in each second subpixel group are negative.

For example, in the case of inputting scanning signals into the gate lines corresponding to any row of subpixels, the preset sequence is: sequentially inputting data signals into data lines corresponding to the second column of subpixels, the first column of subpixels, the third column of subpixels, and the fourth column of subpixels in each subpixel group, and at a same time period, the data signals are inputted into only the data line corresponding to one column of subpixels in each subpixel group.

For example, in the case of inputting scanning signals into the gate lines corresponding to any row of subpixels, the preset sequence is: sequentially inputting the data signals into data lines corresponding to the third column of subpixels, the second column of subpixels, the fourth column of subpixels, and the first column of subpixels in each subpixel group, and at a same time period, the data signals are inputted into only the data line corresponding to one column of subpixels in each subpixel group.

For example, in the case of inputting scanning signals into the gate lines corresponding to odd rows of subpixels, the data signals are sequentially inputted into data lines corresponding to the second column of subpixels, the first column of subpixels, the third column of subpixels, and the fourth column of subpixels in each subpixel group; in the case of inputting scanning signals into the gate lines corresponding to even rows of subpixels, the data signals are sequentially inputted into data lines corresponding to the second column of subpixels, the third column of subpixels, the first column of subpixels, and the fourth column of subpixels in each subpixel group, and at a same time period, the data signals are inputted into only the data line corresponding to one column of subpixels in each subpixel group.

For example, in the case of inputting scanning signals into the gate lines corresponding to odd rows of subpixels, the data signals are sequentially inputted into data lines corresponding to the second column of subpixels, the fourth column of subpixels, the third column of subpixels, and the first column of subpixels in each subpixel group; and in the case of inputting scanning signals into the gate lines corresponding to even rows of subpixels, the data signals are sequentially inputted into data lines corresponding to the second column of subpixels, the third column of subpixels, the fourth column of subpixels, and the first column of subpixels in each subpixel group, and at a same time period, the data signals are inputted into only the data line corresponding to one column of subpixels in each subpixel group.

BRIEF DESCRIPTION OF THE DRAWINGS

The embodiments of the present disclosure will be described in more detail below with reference to the accompanying drawings in order to enable a person of ordinary skill in the art to understand the embodiments of the present disclosure more clearly, in which.

DETAILED DESCRIPTION

Technical solutions of the embodiments will be described in a clearly and fully understandable way in connection with the drawings related to the embodiments of the disclosure. It is apparent that the described embodiments are just a part but not all of the embodiments of the disclosure. Based on the described embodiments herein, one of ordinary skill in the art can obtain other embodiment(s), without any creative work, which shall be within the scope of the disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present disclosure, are not intended to indicate any sequence, amount or importance, but for distinguishing various components. The terms, such as "comprise/comprising," "include/including," or the like are intended to specify that the elements or the objects stated before these terms encompass the elements or the objects and equivalents thereof listed after these terms, but not preclude other elements or objects. The terms, "on," "under," "left," "right," or the like are only used to indicate relative position relationship, and when the position of the object which is described is changed, the relative position relationship may be changed accordingly.

Figure 1:
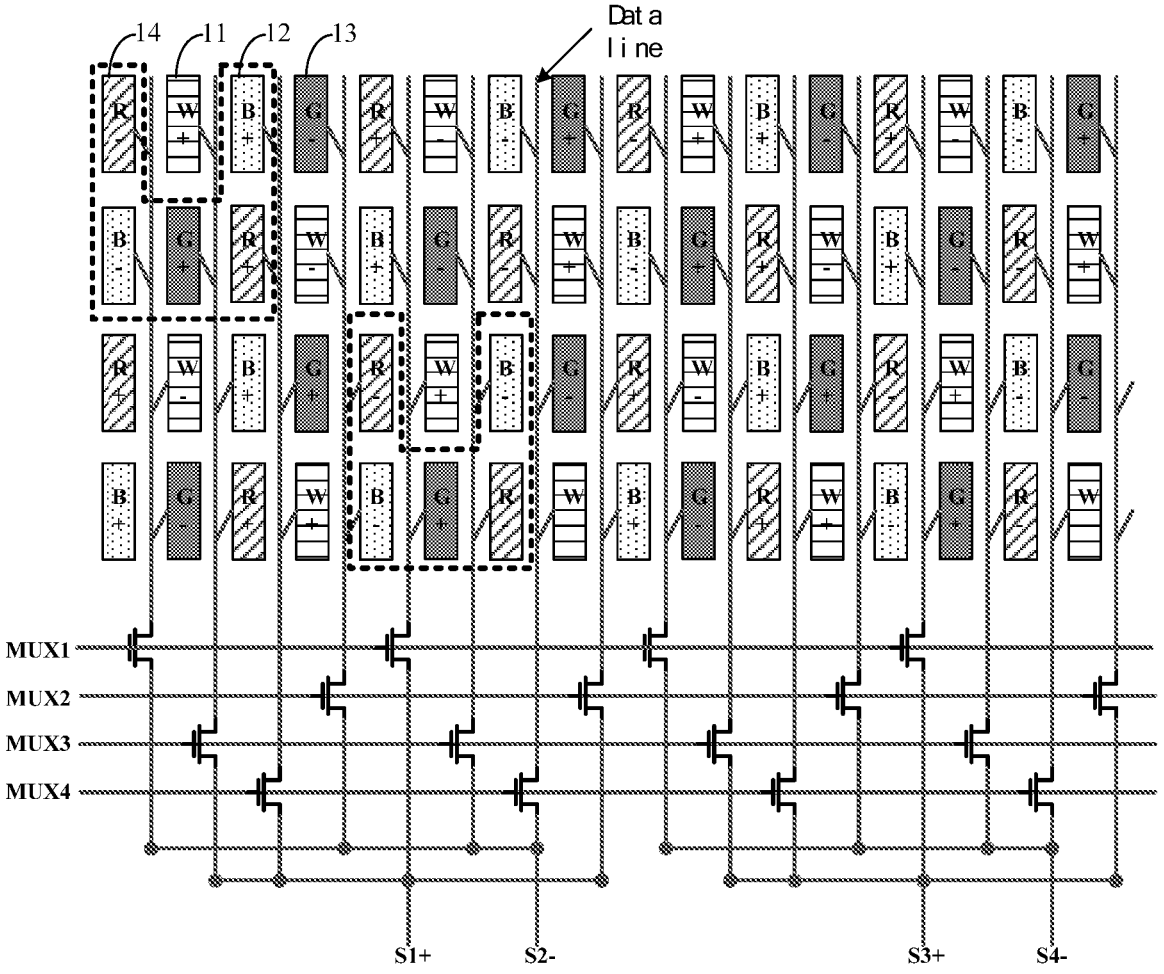
FIG. 1 is an arrangement diagram of a plurality of subpixels in an array substrate.

A liquid crystal display (LCD) comprises an array substrate. A plurality of pixel units are disposed on the array substrate. Each pixel unit includes subpixels of four colors, i.e., red, green, blue, and white. As shown in FIG. 1, four data lines connected with one pixel unit are respectively connected with one data terminal through four switching elements. The data terminal is configured to be connected with a terminal of a data driver IC. In the LCD, in order to avoid the polarization at the common electrode, data signals of opposite polarities can be provided to the subpixels.

The inventors have noticed that when the four switching elements are switched on according to a certain sequence, in the case of displaying a mixed color image of blue and red, blue and green, or red and green, or in the case of displaying a monochromatic image of blue, red, or green, a problem that the brightness of subpixels of a color in adjacent rows is different will present, and then the user will see bright and dark stripes when the user watch the display image.

For instance, as shown in FIG. 1, the array substrate comprises a plurality of subpixels arranged in an array. The plurality of subpixels include subpixels of a first color 11, subpixels of a second color 12, subpixels of a third color 13, and subpixels of a fourth color 14. In odd rows of subpixels, the subpixels of the fourth color 14, the subpixels of the first color 11, the subpixels of the second color 12, and the subpixels of the third color 13 are sequentially arranged. In even rows of subpixels, the subpixels of the second color 12, the subpixels of the third color 13, the subpixels of the fourth color 14, and the subpixels of the first color 11 are sequentially arranged. In odd columns of subpixels, the subpixels of the fourth color 14 and the subpixels of second color 12 are sequentially arranged. In even columns of subpixels, the subpixels of the first color 11 and the subpixels of the third color 13 are sequentially arranged. The array substrate further comprises a plurality of data lines. Each data line is connected with part of subpixels on its two sides. In every four rows of subpixels, each data line is respectively connected with the subpixels of the fourth color 14, the subpixels of the second color 12, the subpixels of the first color 11, and the subpixels of the third color 13 in two adjacent columns of subpixels of the data line. In every four rows and every eight columns of subpixels, negative data signals are inputted into data lines corresponding to the first column of subpixels, the fourth column of subpixels, the sixth column of subpixels, and the seventh column of subpixels in the front two rows of subpixels, and positive data signals are inputted into data lines corresponding to the second column of subpixels, the third column of subpixels, the fifth column of subpixels, and the eighth column of subpixels in the front two rows of subpixels; and positive data signals are inputted into data lines corresponding to the first column of subpixels, the third column of subpixels, the fourth column of subpixels, and the sixth column of subpixels in the last two rows of subpixels, and negative data signals are inputted into data lines corresponding to the second column of subpixels, the fifth column of subpixels, the seventh column of subpixels and the eighth column of subpixels in the last two rows of subpixels.

Supposing that every four data lines are one data signal group, data signals are sequentially inputted into the data line in the first column (a switch MUX1 is switched on), the data line in the fourth column (a switch MUX2 is switched on), the data line in the second column (a switch MUX3 is switched on), and the data line in the third column (a switch MUX4 is switched on) in each data signal group.

Figure 2:
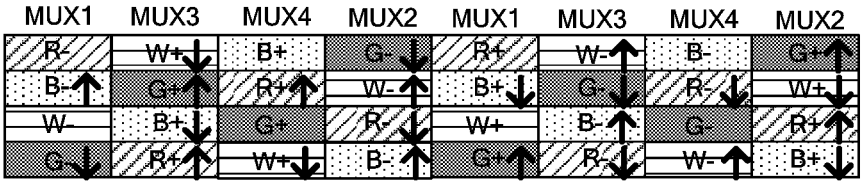
FIG. 2 is a state diagram of a plurality of subpixels when the subpixel arrangement diagram in FIG. 1 is used to display a mixed color image of red and green.

For example, for a G+ subpixel in the fourth row in the case of displaying a mixed color image of red and green, in the case of inputting a scanning signal into the gate line corresponding to the fourth row of subpixels, firstly, a data signal is inputted into the data line in the first column, and at this point, the voltage on the G+ subpixel is 10V (supposing that the preset voltage of subpixels connected with data lines receiving positive data signals is 10V, and the preset voltage of subpixels connected with data lines receiving negative data signals is −10V). Secondly, stopping inputting the data signal into the data line in the first column, inputting the data signal into the data line in the fourth column. At this point, the G+ subpixel is in a floating state. Because the displayed image is a mixed color image of red and green, the voltage on B− subpixel disposed on the left of the G+ subpixel is 0V, and the voltage on R− subpixel, disposed in the previous row of the B− subpixel and connected with the data line in the fourth column together with the B− subpixel, is −10V. In the process of transmitting the data signal from the third row of subpixels to the fourth row of subpixels, an upward voltage jump (from −10V to 0V, as shown by a solid arrow in the B− subpixel in the fourth row in FIG. 2) occurs from the R− subpixel to the B− subpixel as shown in FIG. 2. After that, stopping inputting the data signal into the data line in the fourth column, inputting the data signal into the data line in the second column. At this point, the G+ subpixel is still in the floating state; the voltage on R− subpixel disposed on the right of the G+ subpixel is −10V; and the voltage on B− subpixel, disposed in the previous row of the R− subpixel and connected with the data line in the second column together with the B− subpixel, is 0V. In the process of transmitting the data signal from the third row of subpixels to the fourth row of subpixels, a downward voltage jump (from 0V to −10V, as shown by a solid arrow in the R− subpixel in the fourth row in FIG. 2) occurs from the B− subpixel to the R− subpixel. Finally, stopping inputting the data signal into the data line in the second column, inputting the data signal into the data line in the third column.

In the above process, because there is parasitic capacitance between the B− subpixel disposed on the left of the G+ subpixel and the data line connected with the G+ subpixel, when the G+ subpixel is in the floating state, the voltage on the G+ subpixel will be increased while an upward voltage jump occurs from the R− subpixel to the B− subpixel. Because there is parasitic capacitance between the data line connected with the R− subpixel disposed on the right of the G+ subpixel and the G+ subpixel, when the G+ subpixel is in the floating state, the voltage on the G+ subpixel will be decreased while a downward voltage jump occurs from the B− subpixel to the R− subpixel. In the case of inputting the data signal into the data line connected with W+ subpixel, both the W+ subpixel and the data line connected with the W+ subpixel will not affect the voltage of the G+ subpixel. In summary, the voltage on the G+ subpixel will be increased due to the upward voltage jump from the R− subpixel to the B− subpixel, and the voltage on the G+ subpixel will be decreased due to the downward voltage jump from the B− subpixel to the R− subpixel. The two direction jumps cancel each other out, so the voltage on the G+ subpixel does not change, and the voltage difference between the G+ subpixel and the common electrode does not change. In the case of displaying the mixed color image of red and green, the brightness of the G+ subpixel in the fourth row is the preset brightness.

For example, for the G+ subpixel in the second row in the case of displaying a mixed color image of red and green, in the case of inputting a scanning signal into the gate line corresponding to the second row of subpixels, firstly, the data signal is inputted into the data line in the first column. At this point, the voltage on B− subpixel disposed on the left of the G+ subpixel is 0V, and the voltage on R− subpixel, disposed in the previous row of the B− subpixel and connected with the data line in the first column together with the B− subpixel, is −10V. In the process of transmitting the data signal from the third row of subpixels to the fourth row of subpixels, an upward voltage jump (as shown by a solid arrow in the B− subpixel in the second row in FIG. 2) occurs from the R− subpixel to the B− subpixel. Secondly, stopping inputting the data signal into the data line in the first column, inputting the data signal into the data line in the fourth column. Thirdly, stopping inputting the data signal into the data line in the fourth column, inputting the data signal into the data line in the second column after. At this point, the voltage on the G+ subpixel is 10V. Finally, stopping inputting the data signal into the data line in the second column, inputting the data signal into the data line in the third column. At this point, the G+ subpixel is in the floating state; the voltage on R+ subpixel disposed on the right of the G+ subpixel is 10V; the voltage on B+ subpixel, disposed in the previous row of the R+ subpixel and connected with the data line in the third column together with the R+ subpixel, is 0V; and an upward voltage jump (as shown by a solid arrow in the R+ subpixel in the second row in FIG. 2) occurs from the B+ subpixel to the R+ subpixel.

In the above process, the data signal is not inputted into the data line connected with the G+ subpixel in the process of inputting the data signal into the data line in the first column and the data line in the third column; at this point, even the voltage on the G+ subpixel is increased in the case of the upward voltage jump from the R− subpixel to the B− subpixel, the voltage on the G+ subpixel can also be adjusted in the subsequent process of inputting the data signal into the data line connected with the G+ subpixel; and the upward voltage jump from the R− subpixel to the B− subpixel will not affect the brightness of the G+ subpixel. Because there is parasitic capacitance between the R+ subpixel disposed on the right of the G+ subpixel and the data line connected with the G+ subpixel, when the G+ subpixel is in the floating state, the voltage on the G+ subpixel will be increased while an upward voltage jump occurs from the B+ subpixel to the R+ subpixel, and then the voltage between the G+ subpixel and the common electrode can be increased. In the process of displaying the mixed color image of red and green, the brightness of the G+ subpixel in the second row is greater than the preset brightness.

Similarly, as shown in FIG. 2, in the process of displaying the mixed color image of red and green, for green subpixels, the brightness of the first row of green subpixels is the preset brightness, and the brightness of the third row of green subpixels is also the preset brightness. That is, the brightness of the first row of green subpixels, the third row of green subpixels, and the fourth row of green subpixels, are all the preset brightness, but the brightness of the second row of green subpixels is greater than the preset brightness. In this way, in the process of displaying the mixed color image of red and green, transverse stripes with uneven brightness will appear.

As shown in FIG. 2, in the process of displaying the mixed color image of red and green, for red subpixels, the brightness of the first row of red subpixels, the brightness of the second row of red subpixels, and the brightness of the third row of red subpixels are the preset brightness, and the brightness of the fourth row of red subpixels is less than the preset brightness. In this way, in the process of displaying the mixed color image of red and green, transverse stripes with uneven brightness will appear.

Figure 3:
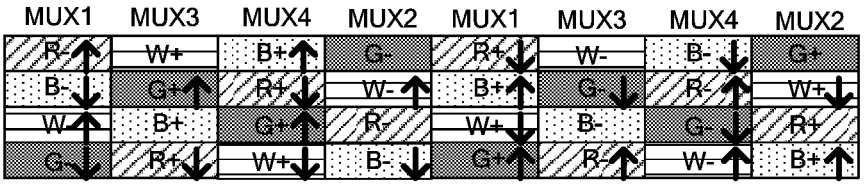
FIG. 3 is a state diagram of a plurality of subpixels when the subpixel arrangement diagram in FIG. 1 is used to display a mixed color image of blue and green.

As shown in FIG. 3, in the process of displaying a mixed color image of blue and green, for green subpixels, the brightness of the first row of green subpixels, and the brightness of the second row of green subpixels are less than the preset brightness, respectively, and the brightness of the third row of green subpixels and the brightness of the fourth row of green subpixels are the preset brightness. In this way, in the process of displaying the mixed color image of blue and green, transverse stripes with uneven brightness will appear.

As shown in FIG. 3, in the process of displaying the mixed color image of blue and green, for blue subpixels, the brightness of the first row of blue subpixels and the brightness of the second row of blue subpixels are the preset brightness, respectively, and the brightness of the third row of blue subpixels and the brightness of the fourth row of blue subpixels are greater than the preset brightness, respectively. In this way, in the process of displaying the mixed color image of blue and green, transverse stripes with uneven brightness will appear.

Figure 4:
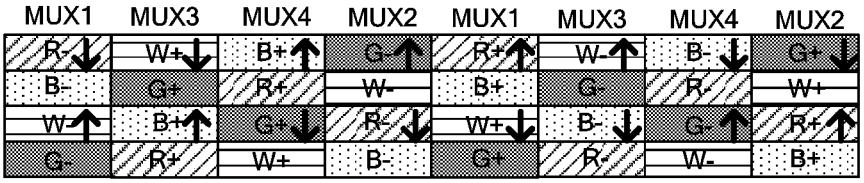
FIG. 4 is a state diagram of a plurality of subpixels when the subpixel arrangement diagram in FIG. 1 is used to display a mixed color image of red and blue.

As shown in FIG. 4, in the process of displaying a mixed color image of blue and red, for blue subpixels, the brightness of the first row of blue subpixels, the brightness of the second row of blue subpixels, and the brightness of the fourth row of blue subpixels are all the preset brightness, respectively, and the brightness of the third row of blue subpixels is less than the preset brightness. In this way, in the process of displaying the mixed color image of blue and red, transverse stripes with uneven brightness will appear.

As shown in FIG. 4, in the process of displaying the mixed color image of blue and red, for red subpixels, the brightness of the first row of red subpixels and the brightness of the third row of red subpixels are both greater than the preset brightness; the brightness of the first row of red subpixels is greater than the brightness of the third row of red subpixels; and the brightness of the second row of red subpixels and the brightness of the fourth row of red subpixels are both the preset brightness. In this way, in the process of displaying the mixed color image of blue and red, transverse stripes with uneven brightness will appear.

Figure 5:
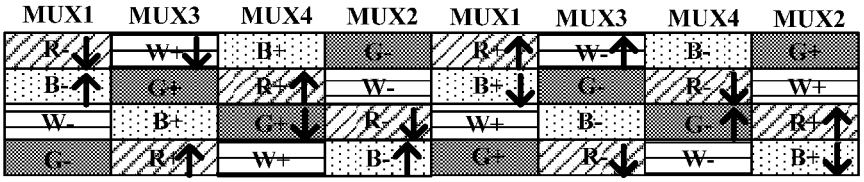
FIG. 5 is a state diagram of a plurality of subpixels when the subpixel arrangement diagram in FIG. 1 is used to display a red image.

As shown in FIG. 5, in the process of displaying a red image, the brightness of the first row of red subpixels and the brightness of the third row of red subpixels are both greater than the preset brightness, and the brightness of the second row of red subpixels and the brightness of the fourth row of red subpixels are both the preset brightness. In this way, in the process of displaying the red image, transverse stripes with uneven brightness will appear.

Figure 6:
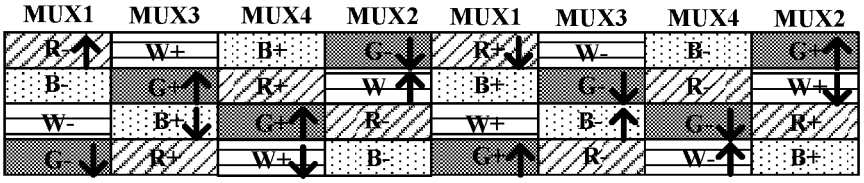
FIG. 6 is a state diagram of a plurality of subpixels when the subpixel arrangement diagram in FIG. 1 is used to display a green image.

As shown in FIG. 6, in the process of displaying a green image, the brightness of the first row of green subpixels, the brightness of the second row of green subpixels, the brightness of the third row of green subpixels, and the brightness of the fourth row of green subpixels are all the preset brightness. In this way, in the process of displaying the green image, transverse stripes with uneven brightness will not appear.

Figure 7:
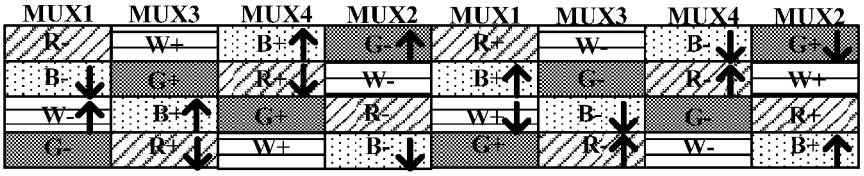
FIG. 7 is a state diagram of a plurality of subpixels when the subpixel arrangement diagram in FIG. 1 is used to display a blue image.

As shown in FIG. 7, in the process of displaying a blue image, the brightness of the first row of blue subpixels, the brightness of the second row of blue subpixels, the brightness of the third row of blue subpixels, and the brightness of the fourth row of blue subpixels are all the preset brightness. In this way, in the process of displaying the blue image, transverse stripes with uneven brightness will not appear.

The foregoing only describes the problems of uneven display brightness and transverse stripes in the process of displaying images of different colors when sequentially inputting the data signal into the data line in the first column, the data line in the fourth column, the data line in the second column, and the data line in the third column in each data signal group. The problems of uneven display brightness and transverse stripes also appear in the process of inputting the data signal into the data line in the first column, the data line in the second column, the data line in the third column, and the data line in the fourth column in each data signal group according to other sequences.

Figure 8:
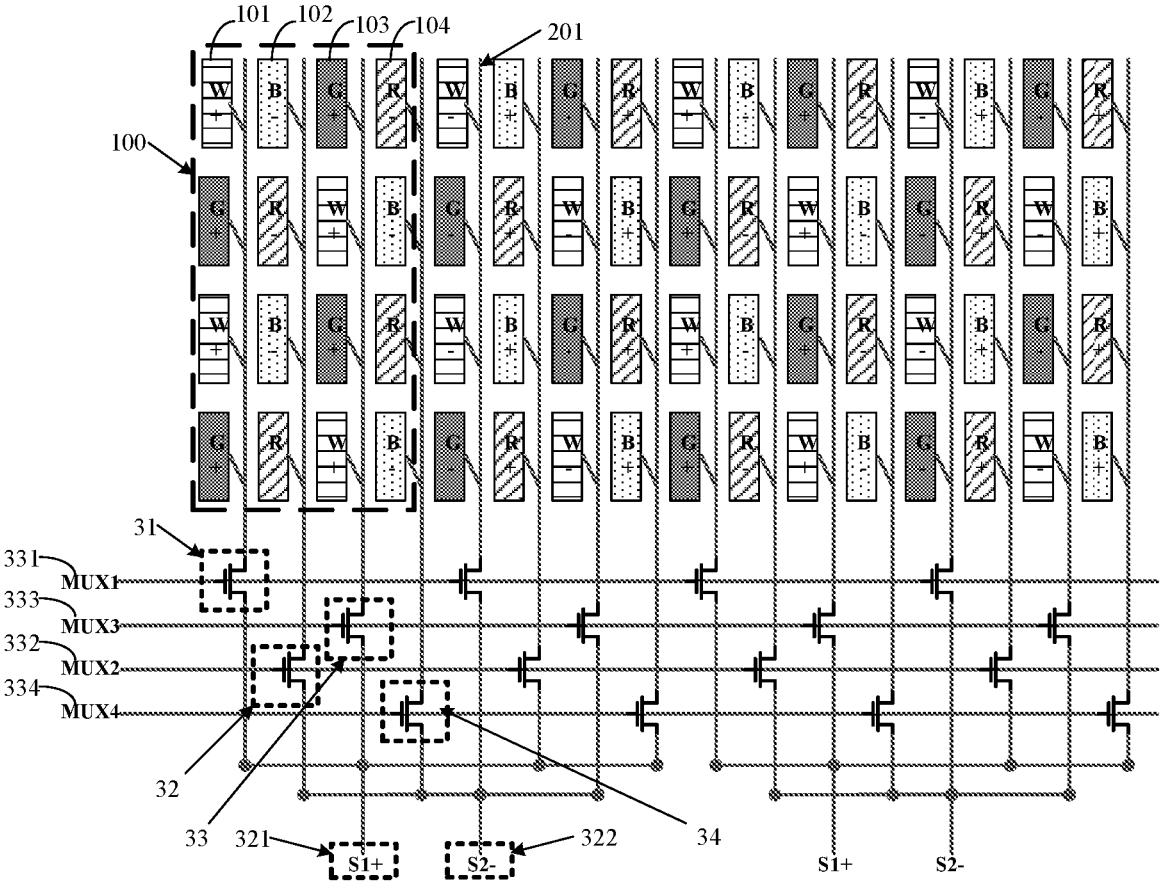
FIG. 8 is an arrangement diagram of a plurality of subpixels in an array substrate provided by an embodiment of the present disclosure.

An embodiment of the present disclosure provides an array substrate, which, as shown in FIG. 8, comprises a plurality of subpixels arranged in an array. The plurality of subpixels include subpixels of a first color 101, subpixels of a second color 102, subpixels of a third color 103, and subpixels of a fourth color 104. In odd rows of subpixels, the subpixels of the first color 101, the subpixels of the second color 102, the subpixels of the third color 103, and the subpixels of the fourth color 104 are sequentially arranged. In even rows of subpixels, the subpixels of the third color 103, the subpixels of the fourth color 104, the subpixels of the first color 101, and the subpixels of the second color 102 are sequentially arranged.

For instance, as shown in FIG. 8, the array substrate further comprises a plurality of data lines 201 and a plurality of switches; each column of subpixels corresponds to and is connected with one data line 201; one end of each data line 201 is electrically connected with a source electrode of one switch; and a drain electrode of the switch is configured to receive data signals.

The plurality of subpixels are divided into a plurality of subpixel groups 100. Each subpixel group 100 includes four adjacent columns of subpixels. Each column of subpixels only belong to one subpixel group 100. The switches include a plurality of first switches 31, a plurality of second switches 32, a plurality of third switches 33, and a plurality of fourth switches 34. In each subpixel group 100, a source electrode of the first switch is electrically connected with the data line 201 corresponding to the first column of subpixels, and a gate electrode of the first switch is electrically connected with a first switch control line (MUX1) 331; a source electrode of the second switch is electrically connected with the data line 201 corresponding to the second column of subpixels, and a gate electrode of the second switch is electrically connected with a second switch control line (MUX2) 332; a source electrode of the third switch is electrically connected with the data line 201 corresponding to the third column of subpixels, and a gate electrode of the third switch is electrically connected with a third switch control line (MUX3) 333; a source electrode of the fourth switch is electrically connected with the data line 201 corresponding to the fourth column of subpixels, and a gate electrode of the fourth switch is electrically connected with a fourth switch control line (MUX4) 334.

The array substrate further comprises first data terminals 321 and second data terminals 322. The first data terminals 321 and the second data terminals 322 are electrically connected with drain electrodes of the switches. The subpixel groups 100 include a first subpixel group and a second subpixel group. The subpixel groups 100 in the odd column are the first subpixel group, and the subpixel groups 100 in the even column are the second subpixel group. The first data terminal 321 is configured to input first data signals into data lines 201 corresponding to odd columns of subpixels in the first subpixel group and even columns of subpixels in the second subpixel group. The second data terminal 322 is configured to input second data signals into data lines 201 corresponding to even columns of subpixels in the first subpixel group and odd columns of subpixels in the second subpixel group. The first data signals and the second data signals are data signals with opposite polarities.

For instance, description is given by using the following as an example: the subpixels of the first color 101 are white subpixels; the subpixels of the second color 102 are blue subpixels; the subpixels of the third color 103 are green subpixels; and the subpixels of the fourth color 104 are red subpixels.

Supposing the second switch, the first switch, the third switch and the fourth switch are sequentially switched on, the first data terminal 321 is adopted to input positive data signals into data lines 201 corresponding to the odd columns of subpixels in the first subpixel group and the even columns of subpixels in the second subpixel group, and the second data terminal 322 is adopted to input negative data signals into data lines 201 corresponding to the even columns of subpixels in the first subpixel group and the odd columns of subpixels in the second subpixel group.

Figure 9:
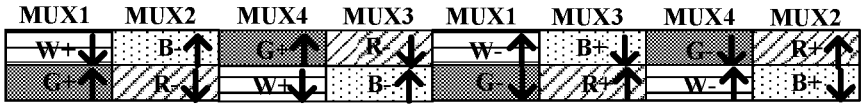
FIG. 9 is a state diagram of a plurality of subpixels when the subpixel arrangement diagram in FIG. 8 is used to display a mixed color image of red and green.

For example, for displaying G+ subpixel in the first row in the process of displaying a mixed color image of red and green, in the case of inputting the scanning signal into the gate line corresponding to the first row of subpixels, firstly, the second switch is switched on. At this point, the first data terminal 321 or the second data terminal 322 inputs data signals into the data lines 201 corresponding to the second column of subpixels in each subpixel group 100 by the second switch; the voltage on B− subpixel disposed on the left of the G+ subpixel is 0V; the voltage on R− subpixel, disposed in the previous row of the B− subpixel (refer to the subpixel in the fourth row) and connected with the same data line 201 together with the B− subpixel, is −10V; and an upward voltage jump (from −10V to 0V, as shown by a solid arrow in the B− subpixel in the first row as shown in FIG. 9) occurs from the R− subpixel to the B− subpixel, as shown in FIG. 9. Then, the second switch is switched off and the first switch is switched on. At this point, the first data terminal 321 or the second data terminal 322 inputs the data signals into the data line 201 corresponding to the first column of subpixels in each subpixel group 100 through the first switch, and the voltage of W+ subpixel is 0V. Then, the first switch is switched off and the third switch is switched on. At this point, the first data terminal 321 or the second data terminal 322 inputs the data signals into the data line 201 corresponding to the third column of subpixels in each subpixel group 100 through the third switch, and the voltage on the G+ subpixel is 10V. Then, the third switch is switched off and the fourth switch is switched on. At this point, the G+ subpixel is in the floating state; the first data terminal 321 or the second data terminal 322 inputs the data signals into the data line 201 corresponding to the fourth column of subpixels in each subpixel group 100 through the fourth switch; the voltage on R− subpixel disposed on the right of the G+ subpixel is −10V; the voltage on B− subpixel, disposed in the previous row of the R− subpixel (refer to the subpixel in the fourth row) and connected with the same data line 201 together with the R− subpixel, is 0V; and a downward voltage jump (from 0V to −10V, as shown by a solid arrow in the B− subpixel in the first row in FIG. 9) occurs from the B− subpixel to the R− subpixel, as shown in FIG. 9.

In the above process, because the data signals are not inputted into the data line 201 connected with the G+ subpixel in the process of switching on the second switch and the first switch, at this point, even an upward voltage jump occurs from the R− subpixel to the B− subpixel, the voltage on the G+ subpixel can also be adjusted in the subsequent process of inputting the data signals into the data line 201 connected with the G+ subpixel, so the upward voltage jump from the R− subpixel to the B− subpixel will not affect the brightness of the G+ subpixels. Because there is parasitic capacitance between the R− subpixel disposed on the right of the G+ subpixel and the data line 201 connected with the G+ subpixel, when the G+ subpixel is in the floating state, the voltage on the G+ subpixel will be decreased while a downward voltage jump occurs from the R− subpixel to the B− subpixel, and then the voltage between the G+ subpixel and the common electrode is decreased. In this way, in the process of displaying the mixed color image of red and green, the brightness of the G+ subpixels in the second row is less than the preset brightness.

For example, for the G+ subpixels in the second row in the process of displaying the mixed color image of red and green, in the case of inputting the scanning signals into the gate line corresponding to the second row of subpixels, the second switch is firstly switched on. At this point, the first data terminal 321 or the second data terminal 322 inputs the data signals into the data line 201 corresponding to the second column of subpixels in each subpixel group 100 through the second switch; the voltage on R− subpixel disposed on the right of the G+ subpixel is −10V; the voltage on B− subpixel, disposed in the previous row of the R− subpixel (the first row) and connected with the same data line 201 together with the R− subpixel, is 0V; and a downward voltage jump (from 0V to −10V, as shown by a solid arrow in the R− subpixel in the second row as shown in FIG. 9) occurs from the B− subpixel to the R− subpixel, as shown in FIG. 9. Then, the second switch is switched off and the first switch is switched on. At this point, the first data terminal 321 or the second data terminal 322 inputs the data signals into the data line 201 corresponding to the first column of subpixels in each subpixel group 100 through the first switch, and the voltage of the G+ subpixel is 10V. Thirdly, the first switch is switched off and the third switch is switched on. At this point, the G+ subpixel is in the floating state, and the first data terminal 321 or the second data terminal 322 inputs the data signals into the data line 201 corresponding to the third column of subpixels in each subpixel group 100 through the third switch, and at this point, the voltage of W+ subpixel is 0V. Finally, the third switch is switched off and the fourth switch is switched on. At this point, the G+ subpixel is in the floating state; the first data terminal 321 or the second data terminal 322 inputs the data signals into the data line 201 corresponding to the fourth column of subpixels in each subpixel group 100 through the fourth switch; the voltage on B+ subpixel disposed on the left of the G+ subpixel is 0V; the voltage on R+ subpixel, disposed in the previous row of the B+ subpixel (refer to the subpixel in the first row) and connected with the same data line 201 together with the B+ subpixel, is 10V; and a downward voltage jump (from 10V to 0V, as shown by a solid arrow in the B+ subpixel in the first row in FIG. 9) occurs from the R+ subpixel to the B+ subpixel, as shown in FIG. 9.

In the above process, as the data signals are not inputted into the data line 201 connected with the G+ subpixel when the second switch is switched on, at this point, even an upward voltage jump occurs from the R− subpixel to the B− subpixel, the voltage on the G+ subpixel can also be adjusted in the subsequent process of inputting the data signals into the data line 201 connected with the G+ subpixel, so the downward voltage jump from the B− subpixel to the R− subpixel will not affect the brightness of the G+ subpixel. In the process of inputting the data signals into the data line 201 connected with W+ subpixel, both the W+ subpixel and the data line 201 connected with the W+ subpixel will not affect the voltage of the G+ subpixel. As there is parasitic capacitance between the data line 201 connected with the B+ subpixel disposed on the left of the G+ subpixel and the G+ subpixel, when the G+ subpixel is in the floating state, the voltage on the G+ subpixel will be decreased while a downward voltage jump occurs from R+ subpixel to B+ subpixel, and then the voltage between the G+ subpixel and the common electrode can be decreased. In this way, in the process of displaying the mixed color image of red and green, the brightness of the G+ subpixel in the second row is also less than the preset brightness. That is, in the process of displaying the mixed color image of red and green, both the brightness of odd rows of G+ columns and the brightness of even rows of G+ subpixels are less than the preset brightness, so no transverse bright and dark stripe appears.

Similarly, as shown in FIG. 9, in the process of displaying the mixed color image of red and green, both the brightness of odd rows of red subpixels and the brightness of even rows of red subpixels are the preset brightness, so no transverse bright and dark stripe appears.

Figure 10:
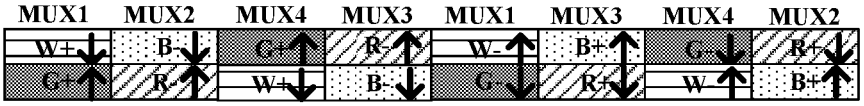
FIG. 10 is a state diagram of a plurality of subpixels when the subpixel arrangement diagram in FIG. 8 is used to display a mixed color image of blue and green.

As shown in FIG. 10, in the process of displaying a mixed color image of blue and green, both the brightness of odd rows of green subpixels and the brightness of even rows of green subpixels are greater than the preset brightness, so no transverse bright and dark stripe appears.

As shown in FIG. 10, in the process of displaying the mixed color image of blue and green, both the brightness of odd rows of blue subpixels and the brightness of even rows of blue subpixels are the preset brightness, so no transverse bright and dark stripe appears.

Figure 11:
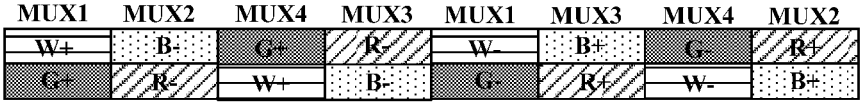
FIG. 11 is a state diagram of a plurality of subpixels when the subpixel arrangement diagram in FIG. 8 is used to display a mixed color image of red and blue.

As shown in FIG. 11, in the process of displaying a mixed color image of blue and red, both the brightness of odd rows of red subpixels and blue subpixels and the brightness of even rows of red subpixels and blue subpixels are the preset brightness, so transverse bright and dark stripes will not appear (no solid arrow is marked for the subpixels in FIG. 11, which represents that the voltage has not jumped).

Figure 12:
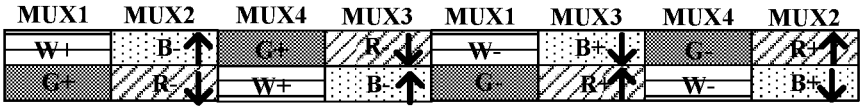
FIG. 12 is a state diagram of a plurality of subpixels when the subpixel arrangement diagram in FIG. 8 is used to display a red image.

As shown in FIG. 12, in the process of displaying a red image, the brightness of odd rows of red subpixels and even rows of red subpixels is the preset brightness, so no transverse bright and dark stripe appears.

Figure 13:
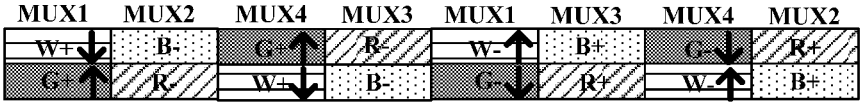
FIG. 13 is a state diagram of a plurality of subpixels when the subpixel arrangement diagram in FIG. 8 is used to display a green image.

As shown in FIG. 13, in the process of displaying a green image, the brightness of odd rows of green subpixels and even rows of green subpixels is the preset brightness, so no transverse bright and dark stripe appears.

Figure 14:
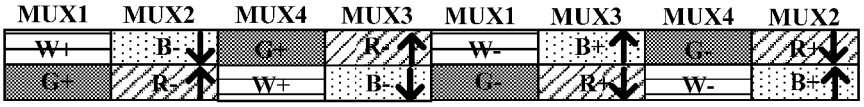
FIG. 14 is a state diagram of a plurality of subpixels when the subpixel arrangement diagram in FIG. 8 is used to display a blue image.

As shown in FIG. 14, in the process of displaying a blue image, the brightness of odd rows of blue subpixels and even rows of blue subpixels is the preset brightness, so no transverse bright and dark stripe appears.

In the case of inputting the data signals into the data lines 201 according to the sequence of sequentially switching on the second switch, the first switch, the third switch, and the fourth switch, no transverse bright and dark stripe appears in the embodiment of the present disclosure.

Supposing that the third switch, the second switch, the fourth switch, and the first switch are sequentially switched on, the first data terminal 321 is adopted to input positive data signals into the data lines 201 corresponding to odd columns of subpixels in the first subpixel group and even columns of subpixels in the second subpixel group, and the second data terminal 322 is adopted to input negative data signals into the data lines 201 corresponding to even columns of subpixels in the first subpixel group and odd columns of subpixels in the second subpixel group.

For example, for displaying R− subpixel in the first row in the process of displaying a mixed color image of red and blue, in the case of inputting a scanning signal into the gate line corresponding to the first row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on G+ subpixel disposed on the left of the R− subpixel is 0V; the voltage of W+ subpixel, disposed in the previous row of the G+ subpixel (as shown by the subpixel in the fourth row) and connected with the same data line 201 together with the G+ subpixel, is 0V; and no voltage jump (0V to 0V) occurs from the W+ subpixel to the G+ subpixel. Secondly, the third switch is switched off and the second switch is switched on. At this point, the first data terminal 321 or the second data terminal 322 inputs the data signals into the data line 201 corresponding to the second column of subpixels in each subpixel group 100 through the second switch, and the voltage on B− subpixel is −10V. Thirdly, the second switch is switched off and the fourth switch is switched on. At this point, the first data terminal 321 or the second data terminal 322 inputs the data signals into the data line 201 corresponding to the fourth column of subpixels in each subpixel group 100 through the fourth switch, and the voltage on the R− subpixel is −10V. Then, the fourth switch is switched off and the first switch is switched on. At this point, the R− subpixel is in the floating state. The first data terminal 321 or the second data terminal 322 inputs the data signals into the data line 201 corresponding to the first column of subpixels in each subpixel group 100 through the first switch; the voltage on W− subpixel disposed on the right of the R− subpixel is 0V; the voltage of G− subpixel, disposed in the previous row of the W− subpixel (as shown by the subpixel in the fourth row) and connected with the same data line 201 together with the W− subpixel, is 0V; and no voltage jump (from 0V to 0V) occurs from the G− subpixel to the W− subpixel.

In the above process, as no voltage jump occurs, even the R− subpixel is in the floating state, the brightness of the R− subpixel will not be affected. That is, in the process of displaying the mixed color image of red and blue, the brightness of the R− subpixel is the preset brightness.

For example, for displaying R− subpixel in the second row in the process of displaying the mixed color image of red and blue, in the case of inputting a scanning signal into gate line corresponding to the second row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on G+ subpixel disposed on the left of the R− subpixel is 0V; the voltage of W+ subpixel, disposed in the previous row of the G+ subpixel (as shown by the subpixel in the fourth row) and connected with the same data line 201 together with the G+ subpixel, is 0V; and no voltage jump (0V to 0V) occurs from the W+ subpixel to the G+ subpixel. Secondly, the third switch is switched off and the second switch is switched on. At this point, the first data terminal 321 or the second data terminal 322 inputs the data signals into the data line 201 corresponding to the second column of subpixels in each subpixel group 100 through the second switch, and the voltage on B− subpixel is −10V. Thirdly, the second switch is switched off and the fourth switch is switched on. At this point, the first data terminal 321 or the second data terminal 322 inputs the data signals into the data line 201 corresponding to the fourth column of subpixels in each subpixel group 100 through the fourth switch, and the voltage on the R− subpixel is −10V. Then, the fourth switch is switched off and the first switch is switched on. At this point, the R− subpixel is in the floating state. The first data terminal 321 or the second data terminal 322 inputs the data signals into the data line 201 corresponding to the first column of subpixels in each subpixel group 100 through the first switch; the voltage on W− subpixel disposed on the right of the R− subpixel is 0V; the voltage of G− subpixel, disposed in the previous row of the W− subpixel (as shown by the subpixel in the fourth row) and connected with the same data line 201 together with the W− subpixel, is 0V; and no voltage jump (from 0V to 0V) occurs from the G− subpixel to the W− subpixel.

In the above process, as no voltage jump occurs, even the R− subpixel is in the floating state, the brightness of the R− subpixel will not be affected. That is, in the process of displaying the mixed color image of red and blue, the brightness of the R− subpixel is the preset brightness.

In the case of inputting the data signals into the data lines 201 according to the sequence of sequentially switching on the third switch, the second switch, the fourth switch, and the first switch, no transverse bright and dark stripe appears in the embodiment of the present disclosure.

Supposing that the second switch, the first switch, the third switch, and the fourth switch are sequentially switched on, so as to input data signals into the data lines 201 corresponding to the odd rows of subpixels; the second switch, the third switch, the first switch, and the fourth switch are sequentially switched on, so as to input data signals into the data lines 201 corresponding to the even rows of subpixels; the first data terminal 321 is adopted to input positive data signals into the data lines 201 corresponding to the odd columns of subpixels in the first subpixel group and the even columns of subpixels in the second subpixel group; and the second data terminal 322 is adopted to input negative data signals into the data lines 201 corresponding to the even columns of subpixels in the first subpixel group and the odd rows of subpixels in the second subpixel group.

For example, for displaying G− subpixel in the first row in the process of displaying a mixed color image of blue and green, in the case of inputting a scanning signal into the gate line corresponding to the first row of subpixels, firstly, the second switch is switched on. At this point, the first data terminal 321 or the second data terminal 322 inputs the data signals into the data line 201 corresponding to the second column of subpixels in each subpixel group 100 through the second switch; the voltage on B+ subpixel disposed on the left of the G− subpixel is 10V; the voltage of R+ subpixel, disposed in the previous row of the B+ subpixel (as shown by the subpixel in the fourth row) and connected with the same data line 201 together with the B+ subpixel, is 0V; and an upward voltage jump (from 0V to 10V) occurs from the R+ subpixel to the B+ subpixel. Secondly, the second switch is switched off and the first switch is switched on. At this point, the first data terminal 321 or the second data terminal 322 inputs the data signals into the data line 201 corresponding to the first column of subpixels in each subpixel group 100 through the first switch, and the voltage of W− subpixel is −10V. Thirdly, the first switch is switched off and the third switch is switched on. The first data terminal 321 or the second data terminal 322 inputs the data signals into the data line 201 corresponding to the third column of subpixels in each subpixel group 100 through the third switch, and the voltage of the G− subpixel is −10V. Then, the third switch is switched off and the fourth switch is switched on. At this point, the G− subpixel is in the floating state. The first data terminal 321 or the second data terminal 322 inputs the data signals into the data line 201 corresponding to the fourth column of subpixels in each subpixel group 100 through the fourth switch; the voltage on R+ subpixel disposed on the right of the G− subpixel is 0V; the voltage of B+ subpixel, disposed in the previous row of the R+ subpixel (as shown by the subpixel in the fourth row) and connected with the same data line 201 together with the R+ subpixel, is 10V; and a downward voltage jump (from 10V to 0V) occurs from the B+ subpixel to the R+ subpixel.

In the above process, as the data signals have not been inputted into the data line 201 connected with the G− subpixel when the second switch and the first switch are switched on, at this point, even an upward voltage jump occurs from the R+ subpixel to the B+ subpixel, the voltage on the G− subpixel can also be adjusted in the subsequent process of inputting the data signals into the data line 201 connected with the G− subpixel, so the upward voltage jump from the R+ subpixel to the B+ subpixel will not affect the brightness of the G− subpixel. As there is parasitic capacitance between the R+ subpixel disposed on the right of the G− subpixel and the data line 201 connected with the G− subpixel, when the G− subpixel is in the floating state, the voltage on the G− subpixel will be decreased (from −10V to −12V) while a downward voltage jump occurs from the B+ subpixel to the R+ subpixel, and then the voltage between the G− subpixel and the common electrode is increased. In this way, in the process of displaying the mixed color image of blue and green, the brightness of the G− subpixel in the first row is greater than the preset brightness.

For example, for displaying G− subpixel in the second row in the process of displaying the mixed color image of blue and green, in the case of inputting a scanning signal into the gate line corresponding to the second row of subpixels, firstly, the second switch is switched on. At this point, the first data terminal 321 or the second data terminal 322 inputs the data signals into the data line 201 corresponding to the second column of subpixels in each subpixel group 100 through the second switch; the voltage on R+ subpixel disposed on the right of the G− subpixel is 0V; the voltage on B+ subpixel, disposed in the previous row of the R+ subpixel (as shown by the subpixel in the first row) and connected with the same data line 201 together with the R+ subpixel, is 10V; and a downward voltage jump (from 10V to 0V) occurs from the B+ subpixel to the R+ subpixel. Secondly, the second switch is switched off and the third switch is switched on. At this point, the first data terminal 321 or the second data terminal 322 inputs the data signals into the data line 201 corresponding to the third column of subpixels in each subpixel group 100 through the third switch, and the voltage on W+ subpixel is −10V. Thirdly, the third switch is switched off and the first switch is switched on. The first data terminal 321 or the second data terminal 322 inputs the data signals into the data line 201 corresponding to the first column of subpixels in each subpixel group 100 through the first switch, and the voltage on the G− subpixel is −10V. Then, the first switch is switched off and the fourth switch is switched on. At this point, the G− subpixel is in the floating state. The first data terminal 321 or the second data terminal 322 inputs the data signals into the data line 201 corresponding to the fourth column of subpixels in each subpixel group 100 through the fourth switch; the voltage on B− subpixel disposed on the left of the G− subpixel is −10V; the voltage of R− subpixel, disposed in the previous row of the B− subpixel (as shown by the subpixel in the first row) and connected with the same data line 201 together with the B− subpixel, is 0V; and a downward voltage jump (from 0V to −10V) occurs from the R− subpixel to the B− subpixel.

In the above process, as the data signals have not been inputted into the data line 201 connected with the G− subpixel when the second switch and the third switch are switched on, at this point, even an upward voltage jump occurs from the R+ subpixel to the B+ subpixel, the voltage on the G− subpixel can also be adjusted in the subsequent process of inputting the data signals into the data line 201 connected with the G− subpixel, so the downward voltage jump from the B+ subpixel to the R+ subpixel will not affect the voltage on the G− subpixel. As there is parasitic capacitance between the data line 201 connected with the B− subpixel disposed on the left of the G− subpixel and the G− subpixel, when the G− subpixel is in the floating state, the voltage on the G− subpixel will be decreased (for instance, from −10V to −12V) which a downward voltage jump occurs from the R− subpixel to the B− subpixel, and then the voltage between the G− subpixel and the common electrode is increased. In this way, in the process of displaying the mixed color image of blue and green, the brightness of the G− subpixel in the second row is greater than the preset brightness.

In the case of inputting the data signals into the data lines 201 connected with the odd rows of subpixels according to the sequence of sequentially switching on the second switch, the first switch, the third switch, and the fourth switch, and inputting the data signals into the data lines 201 connected with the even rows of subpixels according to the sequence of sequentially switching on the second switch, the third switch, the first switch and the fourth switch, no transverse bright and dark stripe appears in the embodiment of the present disclosure.

Supposing that the third switch, the fourth switch, the second switch and the first switch are sequentially switched on, so as to input data signals into the data lines 201 corresponding to the odd rows of subpixels; the third switch, the second switch, the fourth switch, and the first switch are sequentially switched on, so as to input data signals into the data lines 201 corresponding to the even rows of subpixels; the first data terminal 321 is adopted to input positive data signals into the data lines 201 corresponding to the odd columns of subpixels in the first subpixel group and the even columns of subpixels in the second subpixel group; and the second data terminal 322 is adopted to input negative data signals into the data lines 201 corresponding to the even columns of subpixels in the first subpixel group and the odd rows of subpixels in the second subpixel group.

For example, for displaying B+ subpixel in the first row in the process of displaying a mixed color image of blue and red, in the case of inputting a scanning signal into the gate line corresponding to the first row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on G− subpixel disposed on the right of the B+ subpixel is 0V; the voltage on W− subpixel, disposed in the previous row of the G− subpixel (as shown by the subpixel in the fourth row) and connected with the same data line 201 together with the G− subpixel, is 0V; and no voltage jump (0V to 0V) occurs from the W− subpixel to the G− subpixel. Secondly, the third switch is switched off and the fourth switch is switched on. At this point, the first data terminal 321 or the second data terminal 322 inputs the data signals into the data line 201 corresponding to the fourth column of subpixels in each subpixel group 100 through the fourth switch, and the voltage on R− subpixel is −10V. Thirdly, the fourth switch is switched off and the second switch is switched on, the first data terminal 321 or the second data terminal 322 inputs the data signals into the data line 201 corresponding to the second column of subpixels in each subpixel group 100 through the second switch, and the voltage on the B+ subpixel is 10V. Then, the second switch is switched off and the first switch is switched on. At this point, the B+ subpixel is in the floating state. The first data terminal 321 or the second data terminal 322 inputs the data signals into the data line 201 corresponding to the first column of subpixels in each subpixel group 100 through the first switch; the voltage on W− subpixel is 0V; the voltage on G− subpixel, disposed in the previous row of the W− subpixel (as shown by the subpixel in the fourth row) and connected with the same data line 201 together with the W− subpixel, is 0V; and no voltage jump (from 0V to 0V) occurs from the G− subpixel to the W− subpixel.

In the above process, as no voltage jump occurs, even the B+ subpixel is in the floating state, the brightness of the B+ subpixel will not be affected. That is, in the process of displaying the mixed color image of red and blue, the brightness of the B+ subpixel is the preset brightness.

For example, for displaying B+ subpixel in the second row in the process of displaying the mixed color image of blue and red, in the case of inputting a scanning signal into the gate line corresponding to the second row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on W− subpixel disposed on the left of the B+ subpixel is 0V; the voltage on G− subpixel, disposed in the previous row of the W− subpixel (as shown by the subpixel in the first row) and connected with the same data line 201 together with the W− subpixel, is 0V; and no voltage jump (0V to 0V) occurs from the G− subpixel to the W− subpixel. Secondly, the third switch is switched off and the second switch is switched on. At this point, the first data terminal 321 or the second data terminal 322 inputs the data signals into the data line 201 corresponding to the second column of subpixels in each subpixel group 100 through the second switch, and the voltage on R+ subpixel is 10V. Thirdly, the second switch is switched off and the fourth switch is switched on. The first data terminal 321 or the second data terminal 322 inputs the data signals into the data line 201 corresponding to the fourth column of subpixels in each subpixel group 100 through the fourth switch, and the voltage on the B+ subpixel is 10V. Then, the fourth switch is switched off and the first switch is switched on. At this point, the B+ subpixel is in the floating state; the first data terminal 321 or the second data terminal 322 inputs the data signals into the data line 201 corresponding to the first column of subpixels in each subpixel group 100 through the first switch; the voltage on G+ subpixel is 0V; the voltage of W+ subpixel, disposed in the previous row of the G+ subpixel (as shown by the subpixel in the first row) and connected with the same data line 201 together with the G+ subpixel, is 0V; and no voltage jump (from 0V to 0V) occurs from the W+ subpixel to the G+ subpixel.

In the above process, as no voltage jump occurs, even the B+ subpixel is in the floating state, the brightness of the B+ subpixel will not be affected. That is, in the process of displaying the mixed color image of red and blue, the brightness of the B+ subpixel is the preset brightness.

In the case of inputting the data signals into the data lines 201 connected with the odd rows of subpixels according to the sequence of sequentially switching on the third switch, the fourth switch, the second switch, and the first switch, and inputting the data signals into the data lines 201 connected with the even rows of subpixels according to the sequence of sequentially switching on the third switch, the second switch, the fourth switch, and the first switch, no transverse bright and dark stripe appears in the embodiment of the present disclosure It is to be noted that the subpixels of first color 101, the subpixels of second color 102, the subpixels of third color 103, and the subpixels of fourth color 104 may be each others of red subpixels, green subpixels, blue subpixels, and white subpixels; or the subpixels of first color 101, the subpixels of second color 102, the subpixels of third color 103, and the subpixels of fourth color 104 may be each others of magenta subpixels, yellow subpixels, cyan subpixels and white subpixels.

It is also to be noted that when the subpixels of first color 101, the subpixels of second color 102, the subpixels of third color 103, and the subpixels of fourth color 104 may be each others of red subpixels, green subpixels, blue subpixels, and white subpixels, the subpixels of first color 101 may be one of the red subpixels, the green subpixels, the blue subpixels, and the white subpixels; the subpixels of second color 102 may be one of the red subpixels, the green subpixels, the blue subpixels, and the white subpixels; the subpixels of third color 103 may be one of the red subpixels, the green subpixels, the blue subpixels, and the white subpixels; and the subpixels of fourth color 104 may be one of the red subpixels, the green subpixels, the blue subpixels, and the white subpixels. For instance, these four color subpixels are different colors.

When the subpixels of first color 101, the subpixels of second color 102, the subpixels of third color 103, and the subpixels of fourth color 104 may be each others of magenta subpixels, yellow subpixels, cyan subpixels, and white subpixels, the subpixels of first color 101 may be one of the magenta subpixels, the yellow subpixels, the cyan subpixels, and the white subpixels; the subpixels of second color 102 may be one of the magenta subpixels, the yellow subpixels, the cyan subpixels and the white subpixels; the subpixels of third color 103 may be one of the magenta subpixels, the yellow subpixels, the cyan subpixels, and the white subpixels; and the subpixels of fourth color 104 may be one of the magenta subpixels, the yellow subpixels, the cyan subpixels, and the white subpixels. For instance, these four color subpixels are different colors.

It is also to be noted that the switches include first switches 31, second switches 32, third switches 33, and fourth switches 34. Exemplarily, the first switch 31, the second switch 32, the third switch 33, and the fourth switch 34 may be thin film transistors, (TFTs), but the embodiments of the present disclosure are not limited thereto.

For instance, the structures of the first switch 31, the second switch 32, the third switch 33, and the fourth switch 34 may be same or different.

It is also to be noted that the array substrate comprises a plurality of first switches, and a first switch terminal 331 is electrically connected with all the first switches and configured to input gate control signals into all the first switches.

The array substrate comprises a plurality of second switches, and a second switch terminal 332 is electrically connected with all the second switches and configured to input gate control signals into all the second switches.

The array substrate comprises a plurality of third switches, and a third switch terminal 333 is electrically connected with all the third switches and configured to input gate control signals into all the third switches.

The array substrate comprises a plurality of fourth switches, and a fourth switch terminal 334 is electrically connected with all the fourth switches and configured to input gate control signals into all the fourth switches.

It is also to be noted that the first data signal and the second data signal are data signals with opposite polarities refers to that: the first data signal is a positive data signal and the second data signal is a negative data signal; or the first data signal is a negative data signal and the second data signal is a positive data signal.

The embodiment of the present disclosure provides an array substrate. Subpixels in odd rows of subpixels are sequentially arranged according to the sequence of subpixels of first color 101, subpixels of second color 102, subpixels of third color 103, and subpixels of fourth color 104, and subpixels in even rows of subpixels are sequentially arranged according to the sequence of subpixels of third color 103, subpixels of fourth color 104, subpixels of first color 101, and subpixels of second color 102. In a case of one subpixel group 100 including four columns of subpixels, first data signals being inputted into data lines 201 corresponding to odd columns of subpixels in a first subpixel group and even columns of subpixels in a second subpixel group, and second data signals being inputted into data lines 201 corresponding to even columns of subpixels in the first subpixel group and odd columns of subpixels in the second subpixel group, the first data signals and the second data signals are sequentially inputted into the data lines 201 according to a given sequence. In this way, in an image displayed when at least inputting the data signals into data lines 201 corresponding to subpixels of one color and at most inputting the data signals into data lines 201 corresponding to subpixels of three colors, for subpixels of any color corresponding to the data lines 201 receiving the data signals, the brightness of the subpixels in any two adjacent rows is same, so no transverse bright and dark stripes will appear.

For instance, in the process of displaying a red image, the brightness of any two adjacent rows of red subpixels is same; in the process of displaying a green image, the brightness of any two adjacent rows of green subpixels is same; in the process of displaying a blue image, the brightness of any two adjacent rows of blue subpixels is same; and in the process of displaying a white image, the brightness of any two adjacent rows of white subpixels is same.

In the process of displaying a mixed color image of red and green, the brightness of any two adjacent rows of red subpixels is same, and the brightness of any two adjacent rows of green subpixels is same; in the process of displaying a mixed color image of green and blue, the brightness of any two adjacent rows of green subpixels is same, and the brightness of any two adjacent rows of blue subpixels is same; in the process of displaying a mixed color image of red and blue, the brightness of any two adjacent rows of red subpixels is same, and the brightness of any two adjacent rows of blue subpixels is same; in the process of displaying a mixed color image of red and white, the brightness of any two adjacent rows of red subpixels is same, and the brightness of any two adjacent rows of white subpixels is same; in the process of displaying a mixed color image of blue and white, the brightness of any two adjacent rows of blue subpixels is same, and the brightness of any two adjacent rows of white subpixels is same; and in the process of displaying a mixed color image of green and white, the brightness of any two adjacent rows of green subpixels is same, and the brightness of any two adjacent rows of white subpixels is same.

In the process of displaying a mixed color image of red, green and blue, the brightness of any two adjacent rows of red subpixels is same, the brightness of any two adjacent rows of green subpixels is same, and the brightness of any two adjacent rows of blue subpixels is same. In the process of displaying a mixed color image of red, green and white, the brightness of any two adjacent rows of red subpixels is same, the brightness of any two adjacent rows of green subpixels is same, and the brightness of any two adjacent rows of white subpixels is same. In the process of displaying a mixed color image of red, white and blue, the brightness of any two adjacent rows of red subpixels is same, the brightness of any two adjacent rows of white subpixels is same, and the brightness of any two adjacent rows of blue subpixels is same. In the process of displaying a mixed color image of white, green and blue, the brightness of any two adjacent rows of white subpixels is same, the brightness of any two adjacent rows of green subpixels is same, and the brightness of any two adjacent rows of blue subpixels is same.

For instance, the array substrate comprises a display area and a peripheral area outside of the display area. The plurality of subpixels are disposed in the display area. The switches, the first switch control line 331, the second switch control line 332, the third switch control line 333, the fourth switch control line 334, the first data terminals 321, and the second data terminals 322 are disposed in the peripheral area.

In the embodiment of the present disclosure, the switches, the first switch control line 331, the second switch control line 332, the third switch control line 333, the fourth switch control line 334, the first data terminals 321, and the second data terminals 322 are disposed in the peripheral area to avoid the impact on the aperture ratio of the array substrate.

For instance, the subpixel includes a thin film transistor (TFT) and a pixel electrode; a drain electrode of the TFT is electrically connected with the pixel electrode; and the switch and the TFT are arranged in the same layer.

In the embodiment of the present disclosure, when the structure of the switch is the same as the structure of the TFT, the switch is formed at the same time when the TFT in the subpixel is formed, so the manufacturing process of the array substrate can be simplified.

An embodiment of the present disclosure also provides a display panel, which comprises the array substrate provided by any foregoing embodiment.

Herein, the display panel, for instance, may be a liquid crystal display (LCD) panel.

The LCD panel further comprises an opposite substrate and a liquid crystal layer disposed between the array substrate and the opposite substrate. Moreover, the display panel further comprises a common electrode disposed on the array substrate or the opposite substrate.

The embodiment of the present disclosure provides a display panel, which comprises the array substrate. Subpixels in odd rows of subpixels are sequentially arranged according to the sequence of subpixels of first color 101, subpixels of second color 102, subpixels of third color 103 and subpixels of fourth color 104. Subpixels in even rows of subpixels are sequentially arranged according to the sequence of subpixels of third color 103, subpixels of fourth color 104, subpixels of first color 101, and subpixels of second color 102. The subpixel group 100 includes four columns of subpixels; first data signals are inputted into data lines 201 corresponding to odd columns of subpixels in the first subpixel group and even columns of subpixels in the second subpixel group; and second data signals are inputted into data lines 201 corresponding to even columns of subpixels in the first subpixel group and odd columns of subpixels in the second subpixel group. In this case, the first data signals and the second data signals are sequentially inputted into the data lines 201 according to a given sequence. In this way, in an image displayed when at least inputting the data signals into data lines 201 corresponding to subpixels of one color and at most inputting the data signals into data lines 201 corresponding to subpixels of three colors, for subpixels of any color corresponding to the data lines 201 receiving the data signals, the brightness of the subpixels in any two adjacent rows is same, so no transverse bright and dark stripes appear.

For instance, in the process of displaying a red image, the brightness of any two adjacent rows of red subpixels is same; in the process of displaying a green image, the brightness of any two adjacent rows of green subpixels is same; in the process of displaying a blue image, the brightness of any two adjacent rows of blue subpixels is same; and in the process of displaying a white image, the brightness of any two adjacent rows of white subpixels is same.

In the process of displaying a mixed color image of red and green, the brightness of any two adjacent rows of red subpixels is same, and the brightness of any two adjacent rows of green subpixels is same; in the process of displaying a mixed color image of green and blue, the brightness of any two adjacent rows of green subpixels is same, and the brightness of any two adjacent rows of blue subpixels is same; in the process of displaying a mixed color image of red and blue, the brightness of any two adjacent rows of red subpixels is same, and the brightness of any two adjacent rows of blue subpixels is same; in the process of displaying a mixed color image of red and white, the brightness of any two adjacent rows of red subpixels is same, and the brightness of any two adjacent rows of white subpixels is same; in the process of displaying a mixed color image of blue and white, the brightness of any two adjacent rows of blue subpixels is same, and the brightness of any two adjacent rows of white subpixels is same; and in the process of displaying a mixed color image of green and white, the brightness of any two adjacent rows of green subpixels is same, and the brightness of any two adjacent rows of white subpixels is same.

In the process of displaying a mixed color image of red, green and blue, the brightness of any two adjacent rows of red subpixels is same, the brightness of any two adjacent rows of green subpixels is same, and the brightness of any two adjacent rows of blue subpixels is same. In the process of displaying a mixed color image of red, green and white, the brightness of any two adjacent rows of red subpixels is same, the brightness of any two adjacent rows of green subpixels is same, and the brightness of any two adjacent rows of white subpixels is same. In the process of displaying a mixed color image of red, white and blue, the brightness of any two adjacent rows of red subpixels is same, the brightness of any two adjacent rows of white subpixels is same, and the brightness of any two adjacent rows of blue subpixels is same. In the process of displaying a mixed color image of white, green and blue, the brightness of any two adjacent rows of white subpixels is same, the brightness of any two adjacent rows of green subpixels is same, and the brightness of any two adjacent rows of blue subpixels is same.

The embodiment of the present disclosure provides a method of driving the display panel provided by any foregoing embodiment. The array substrate further includes a plurality of gate lines. Each row of subpixels corresponds to and is connected with one gate line. The driving method comprises: when displaying a preset image in the case of inputting scanning signals into gate lines, inputting data signals into a plurality of data lines 201 according to a preset sequence, so that the brightness of subpixels of the same color in any two adjacent rows of subpixels can be same when displaying the preset image. The preset image is an image displayed when at least inputting the data signals into data lines 201 corresponding to subpixels of one color and at most inputting the data signals into data lines 201 corresponding to subpixels of three colors.

The subpixels of first color 101 are white subpixels; the subpixels of second color 102 are blue subpixels; the subpixels of third color 103 are green subpixels; and the subpixels of fourth color 104 are red subpixels.

Data signals inputted into the data lines 201 corresponding to odd columns of subpixels in each first subpixel group and even columns of subpixels in each second subpixel group are positive; and data signals inputted into the data lines 201 corresponding to even columns of subpixels in each first subpixel group and odd columns of subpixels in each second subpixel group are negative.

Exemplarily, in the case of inputting the scanning signal into the gate line corresponding to any row of subpixels, the preset sequence is: sequentially inputting the data signals into the data lines 201 corresponding to the second column of subpixels, the first column of subpixels, the third column of subpixels, and the fourth column of subpixels in each subpixel group 100, and at the same time period, only inputting the data signals into the data line 201 corresponding to one column of subpixels in each subpixel group 100.

For example, for displaying G+ subpixel in the first row in the process of displaying a mixed color image of red and green as an example, in the case of inputting the scanning signal into the gate line corresponding to the first row of subpixels, firstly, the second switch is switched on. At this point, the first data terminal 321 or the second data terminal 322 inputs the data signals into the data line 201 corresponding to the second column of subpixels in each subpixel group 100 through the second switch; the voltage on B− subpixel disposed on the left of the G+ subpixel is 0V; the voltage on R− subpixel, disposed in the previous row of the B− subpixel (as shown by the subpixel in the fourth row) and connected with the same data line 201 together with the B− subpixel, is −10V; and an upward voltage jump (from −10V to 0V, as shown by a solid arrow in the B− subpixel in the first row as shown in FIG. 9) occurs from the R− subpixel to the B− subpixel, as shown in FIG. 9. Secondly, the second switch is switched off and the first switch is switched on. At this point, the first data terminal 321 or the second data terminal 322 inputs the data signals into the data line 201 corresponding to the first column of subpixels in each subpixel group 100 through the first switch, and the voltage on W+ subpixel is 0V. Thirdly, the first switch is switched off and the third switch is switched on. At this point, the first data terminal 321 or the second data terminal 322 inputs the data signals into the data line 201 corresponding to the third column of subpixels in each subpixel group 100 through the third switch, and the voltage on the G+ subpixel is 10V. Then, the third switch is switched off and the fourth switch is switched on. At this point, the G+ subpixel is in the floating state; the first data terminal 321 or the second data terminal 322 inputs the data signals into the data line 201 corresponding to the fourth column of subpixels in each subpixel group 100 through the fourth switch; the voltage on R− subpixel disposed on the right of the G+ subpixel is −10V; the voltage on B− subpixel, disposed in the previous row of the R− subpixel (as shown by the subpixel in the fourth row) and connected with the same data line 201 together with the R− subpixel, is 0V; and a downward voltage jump (from 0V to −10V, as shown by a solid arrow in the B− subpixel in the first row in FIG. 9) occurs from the B− subpixel to the R− subpixel, as shown in FIG. 9.

In the above process, as the data signals have not been inputted into the data line 201 connected with the G+ subpixel in the process of switching on the second switch and the first switch, at this point, even an upward voltage jump occurs from the R− subpixel to the B− subpixel, the voltage on the G+ subpixel can also be adjusted in the subsequent process of inputting the data signals into the data line 201 connected with the G+ subpixel, so the upward voltage jump from the R− subpixel to the B− subpixel will not affect the brightness of the G+ subpixel. As there is parasitic capacitance between the R− subpixel disposed on the right of the G+ subpixel and the data line 201 connected with the G+ subpixel, when the G+ subpixel is in the floating state, the voltage on the G+ subpixel will be decreased while a downward voltage jump occurs from the R− subpixel to the B− subpixel, and then the voltage between the G+ subpixel and the common electrode can be decreased. In this way, in the process of displaying the mixed color image of red and green, the brightness of the G+ subpixel in the second row is less than the preset brightness.

For displaying G+ subpixel in the second row in the process of displaying the mixed color image of red and green as an example, in the case of inputting the scanning signal into gate line corresponding to the second row of subpixels, the second switch is switched on firstly. At this point, the first data terminal 321 or the second data terminal 322 inputs the data signals into the data line 201 corresponding to the second column of subpixels in each subpixel group 100 through the second switch; the voltage on R− subpixel disposed on the right of the G+ subpixel is −10V; the voltage on B− subpixel, disposed in the previous row of the R− subpixel (the first row) and connected with the same data line 201 together with the R− subpixel, is 0V; and a downward voltage jump (from 0V to −10V, as shown by a solid arrow in the R− subpixel in the second row as shown in FIG. 9) occurs from the B− subpixel to the R− subpixel, as shown in FIG. 9. Secondly, the second switch is switched off and the first switch is switched on. At this point, the first data terminal 321 or the second data terminal 322 inputs the data signals into the data line 201 corresponding to the first column of subpixels in each subpixel group 100 through the first switch, and the voltage on the G+ subpixel is 10V. Then, the first switch is switched off and the third switch is switched on. At this point, the G+ subpixel is in the floating state, and the first data terminal 321 or the second data terminal 322 inputs the data signals into the data line 201 corresponding to the third column of subpixels in each subpixel group 100 through the third switch, and at this point, the voltage on W+ subpixel is 0V. Then, the third switch is switched off and the fourth switch is switched on. At this point, the G+ subpixel is in the floating state; the first data terminal 321 or the second data terminal 322 inputs the data signals into the data line 201 corresponding to the fourth column of subpixels in each subpixel group 100 through the fourth switch; the voltage on B+ subpixel disposed on the left of the G+ subpixel is 0V; the voltage on R+ subpixel, disposed in the previous row of the B+ subpixel (as shown by the subpixel in the first row) and connected with the same data line 201 together with the B+ subpixel, is 10V; and a downward voltage jump (from 10V to 0V, as shown by a solid arrow in B+ subpixel in the first row in FIG. 9) occurs from the R+ subpixel to the B+ subpixel, as shown in FIG. 9.

In the above process, as the data signals have not been inputted into the data line 201 connected with the G+ subpixel in the process of switching on the second switch, at this point, even an upward voltage jump occurs from the R− subpixel to the B− subpixel, the voltage on the G+ subpixel can also be adjusted in the subsequent process of inputting the data signals into the data line 201 connected with the G+ subpixel, so the downward voltage jump from the B− subpixel to the R− subpixel will not affect the brightness of the G+ subpixel. In the process of inputting the data signals into the data line 201 connected with W+ subpixel, both the W+ subpixel and the data line 201 connected with the W+ subpixel will not affect the voltage of the G+ subpixel. As there is parasitic capacitance between the data line 201 connected with the B+ subpixel disposed on the left of the G+ subpixel and the G+ subpixel, when the G+ subpixel is in the floating state, the voltage on the G+ subpixel will be decreased while a downward voltage jump occurs from the R+ subpixel to the B+ subpixel, and then the voltage between the G+ subpixel and the common electrode can be decreased. In this way, in the process of displaying the mixed color image of red and green, the brightness of the G+ subpixel in the second row is also less than the preset brightness.

In the embodiment of the present disclosure, in the case of inputting the data signals into the data lines 201 according to the sequence of sequentially switching on the second switch, the first switch, the third switch, and the fourth switch, no transverse bright and dark stripe will appear; Or in the case of inputting the scanning signal into the gate line corresponding to any row of subpixels, the preset sequence is: sequentially inputting the data signals into the data lines 201 corresponding to the third column of subpixels, the second column of subpixels, the fourth column of subpixels, and the first column of subpixels in each subpixel group 100, and at the same period, only inputting the data signals into the data line 201 corresponding to one column of subpixels in each subpixel group 100.

For example, for displaying R− subpixel in the first row in the process of displaying a mixed color image of red and blue as an example, in the case of inputting the scanning signal into the gate line corresponding to the first row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on G+ subpixel disposed on the left of the R− subpixel is 0V; the voltage of W+ subpixel, disposed in the previous row of the G+ subpixel (as shown by the subpixel in the fourth row) and connected with the same data line 201 together with the G+ subpixel, is 0V; and no voltage jump (0V to 0V) occurs from the W+ subpixel to the G+ subpixel. Secondly, the third switch is switched off and the second switch is switched on. At this point, the first data terminal 321 or the second data terminal 322 inputs the data signals into the data line 201 corresponding to the second column of subpixels in each subpixel group 100 through the second switch, and the voltage on B− subpixel is −10V. Then, the second switch is switched off and the fourth switch is switched on. At this point, the first data terminal 321 or the second data terminal 322 inputs the data signals into the data line 201 corresponding to the fourth column of subpixels in each subpixel group 100 through the fourth switch, and the voltage on the R− subpixel is −10V. Then, the fourth switch is switched off and the first switch is switched on. At this point, the R− subpixel is in the floating state; the first data terminal 321 or the second data terminal 322 inputs the data signals into the data line 201 corresponding to the first column of subpixels in each subpixel group 100 through the first switch; the voltage on W− subpixel disposed on the right of the R− subpixel is 0V; the voltage on G− subpixel, disposed in the previous row of the W− subpixel (as shown by the subpixel in the fourth row) and connected with the same data line 201 together with the W− subpixel, is 0V; and no voltage jump (from 0V to 0V) occurs from the G− subpixel to the W− subpixel.

In the above process, as no voltage jump occurs, even the R− subpixel is in the floating state, the brightness of the R− subpixel will not be affected. That is, in the process of displaying the mixed color image of red and blue, the brightness of the R− subpixel is the preset brightness.

For example, for displaying R− subpixel in the second row in the process of displaying the mixed color image of red and blue as an example, in the case of inputting the scanning signal into gate line corresponding to the second row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on G+ subpixel disposed on the left of the R− subpixel is 0V; the voltage on W+ subpixel, disposed in the previous row of the G+ subpixel (as shown by the subpixel in the fourth row) and connected with the same data line 201 together with the G+ subpixel, is 0V; and no voltage jump (0V to 0V) occurs from the W+ subpixel to the G+ subpixel. Secondly, the third switch is switched off and the second switch is switched on. At this point, the first data terminal 321 or the second data terminal 322 inputs the data signals into the data line 201 corresponding to the second column of subpixels in each subpixel group 100 through the second switch, and the voltage on B− subpixel is −10V. Thirdly, the second switch is switched off and the fourth switch is switched on. The first data terminal 321 or the second data terminal 322 inputs the data signals into the data line 201 corresponding to the fourth column of subpixels in each subpixel group 100 through the fourth switch, and the voltage on the R− subpixel is −10V. Then, the fourth switch is switched off and the first switch is switched on. At this point, the R− subpixel is in the floating state; the first data terminal 321 or the second data terminal 322 inputs the data signals into the data line 201 corresponding to the first column of subpixels in each subpixel group 100 through the first switch; the voltage on W− subpixel disposed on the right of the R− subpixel is 0V; the voltage of G− subpixel, disposed in the previous row of the W− subpixel (as shown by the subpixel in the fourth row) and connected with the same data line 201 together with the W− subpixel, is 0V; and no voltage jump (from 0V to 0V) occurs from the G− subpixel to the W− subpixel.

In the above process, as no voltage jump occurs, even the R− subpixel is in the floating state, the brightness of the R− subpixel will not be affected. That is, in the process of displaying the mixed color image of red and blue, the brightness of the R− subpixel is the preset brightness.

In the case of inputting the data signals into the data lines 201 according to the sequence of sequentially switching on the third switch, the second switch, the fourth switch, and the first switch, no transverse bright and dark stripe will appear in the embodiment of the present disclosure; Or in the case of inputting the scanning signals into the gate lines corresponding to odd rows of subpixels, the data signals are sequentially inputted into the data lines 201 corresponding to the second column of subpixels, the first column of subpixels, the third column of subpixels, and the fourth column of subpixels in each subpixel group 100; and in the case of inputting the scanning signals into the gate lines corresponding to even rows of subpixels, the data signals are sequentially inputted into the data lines 201 corresponding to the second column of subpixels, the third column of subpixels, the first column of subpixels, and the fourth column of subpixels in each subpixel group 100, and at the same time period, the data signals are only inputted into the data line 201 corresponding to one column of subpixels in each subpixel group 100.

For example, for displaying G− subpixel in the first row in the process of displaying a mixed color image of blue and green as an example, in the case of inputting the scanning signal into the gate line corresponding to the first row of subpixels, firstly, the second switch is switched on. At this point, the first data terminal 321 or the second data terminal 322 inputs the data signals into the data line 201 corresponding to the second column of subpixels in each subpixel group 100 through the second switch; the voltage on B+ subpixel disposed on the left of the G− subpixel is 10V; the voltage of R+ subpixel, disposed in the previous row of the B+ subpixel (as shown by the subpixel in the fourth row) and connected with the same data line 201 together with the B+ subpixel, is 0V; and an upward voltage jump (from 0V to 10V) occurs from the R+ subpixel to the B+ subpixel. Secondly, the second switch is switched off and the first switch is switched on. At this point, the first data terminal 321 or the second data terminal 322 inputs the data signals into the data line 201 corresponding to the first column of subpixels in each subpixel group 100 through the first switch, and the voltage on W− subpixel is −10V. Thirdly, the first switch is switched off and the third switch is switched on. The first data terminal 321 or the second data terminal 322 inputs the data signals into the data line 201 corresponding to the third column of subpixels in each subpixel group 100 through the third switch, and the voltage on the G− subpixel is −10V. Then, the third switch is switched off and the fourth switch is switched on. At this point, the G− subpixel is in the floating state; the first data terminal 321 or the second data terminal 322 inputs the data signals into the data line 201 corresponding to the fourth column of subpixels in each subpixel group 100 through the fourth switch; the voltage on R+ subpixel disposed on the right of the G− subpixel is 0V; the voltage on B+ subpixel, disposed in the previous row of the R+ subpixel (as shown by the subpixel in the fourth row) and connected with the same data line 201 together with the R+ subpixel, is 10V; and a downward voltage jump (from 10V to 0V) occurs from the B+ subpixel to the R+ subpixel.

In the above process, as the data signals have not been inputted into the data line 201 connected with the G− subpixel in the process of switching on the second switch and the first switch, at this point, even an upward voltage jump occurs from the R+ subpixel to the B+ subpixel, the voltage on the G− subpixel can also be adjusted in the subsequent process of inputting the data signals into the data line 201 connected with the G− subpixel, so the upward voltage jump from the R+ subpixel to the B+ subpixel will not affect the voltage on the G− subpixel. As there is parasitic capacitance between the R+ subpixel disposed on the right of the G− subpixel and the data line 201 connected with the G− subpixel, when the G− subpixel is in the floating state, the voltage on the G− subpixel will be decreased (e.g., form −10V to −12V) while a downward voltage jump occurs from the B+ subpixel to the R+ subpixel, and then the voltage between the G− subpixel and the common electrode can be increased. In this way, in the process of displaying the mixed color image of blue and green, the brightness of the G− subpixel in the first row is greater than the preset brightness.

For example, for displaying G− subpixel in the second row in the process of displaying the mixed color image of blue and green as an example, in the case of inputting the scanning signal into gate line corresponding to the second row of subpixels, firstly, the second switch is switched on. At this point, the first data terminal 321 or the second data terminal 322 inputs the data signals into the data line 201 corresponding to the second column of subpixels in each subpixel group 100 through the second switch; the voltage on R+ subpixel disposed on the right of the G− subpixel is 0V; the voltage of B+ subpixel, disposed in the previous row of the R+ subpixel (as shown by the subpixel in the first row) and connected with the same data line 201 together with the R+ subpixel, is 10V; and a downward voltage jump (from 10V to 0V) occurs from the B+ subpixel to the R+ subpixel. Secondly, the second switch is switched off and the third switch is switched on. At this point, the first data terminal 321 or the second data terminal 322 inputs the data signals into the data line 201 corresponding to the third column of subpixels in each subpixel group 100 through the third switch, and the voltage of W+ subpixel is −10V. Thirdly, the third switch is switched off and the first switch is switched on. The first data terminal 321 or the second data terminal 322 inputs the data signals into the data line 201 corresponding to the first column of subpixels in each subpixel group 100 through the first switch, and the voltage on the G− subpixel is −10V. Then, the first switch is switched off and the fourth switch is switched on. At this point, the G− subpixel is in the floating state; the first data terminal 321 or the second data terminal 322 inputs the data signals into the data line 201 corresponding to the fourth column of subpixels in each subpixel group 100 through the fourth switch; the voltage on B− subpixel disposed on the left of the G− subpixel is −10V; the voltage on R− subpixel, disposed in the previous row of the B− subpixel (as shown by the subpixel in the first row) and connected with the same data line 201 together with the B− subpixel, is 0V; and a downward voltage jump (from 0V to −10V) occurs from the R− subpixel to the B− subpixel.

In the above process, as the data signals have not been inputted into the data line 201 connected with the G− subpixel in the process of switching on the second switch and the third switch, at this point, even an upward voltage jump occurs from the R+ subpixel to the B+ subpixel, the voltage on the G− subpixel can also be adjusted in the subsequent process of inputting the data signals into the data line 201 connected with the G− subpixel, so the downward voltage jump from the B+ subpixel to the R+ subpixel will not affect the voltage on the G− subpixel. As there is parasitic capacitance between the data line 201 connected with the B− subpixel disposed on the left of the G− subpixel and the G− subpixel, when the G− subpixel is in the floating state, the voltage on the G− subpixel will be decreased (for instance, from −10V to −12V) while a downward voltage jump occurs from the R− subpixel to the B− subpixel, and then the voltage between the G− subpixel and the common electrode can be increased. In this way, in the process of displaying the mixed color image of blue and green, the brightness of the G− subpixel in the second row is greater than the preset brightness.

In the case of inputting the data signals into the data lines 201 connected with the odd rows of subpixels according to the sequence of sequentially switching on the second switch, the first switch, the third switch, and the fourth switch and inputting the data signals into the data lines 201 connected with the even rows of subpixels according to the sequence of sequentially switching on the second switch, the third switch, the first switch, and the fourth switch, no transverse bright and dark stripe will appear in the embodiment of the present disclosure; Or in the case of inputting the scanning signals into the gate lines corresponding to odd rows of subpixels, the data signals are sequentially inputted into the data lines 201 corresponding to the second column of subpixels, the fourth column of subpixels, the third column of subpixels, and the first column of subpixels in each subpixel group 100; and in the case of inputting the scanning signals into the gate lines corresponding to even rows of subpixels, the data signals are sequentially inputted into the data lines 201 corresponding to the second column of subpixels, the third column of subpixels, the fourth column of subpixels, and the first column of subpixels in each subpixel group 100, and at the same time period, the data signals are only inputted into the data lines 201 corresponding to one column of subpixels in each subpixel group 100.

For example, for displaying B+ subpixel in the first row in the process of displaying a mixed color image of blue and red as an example, in the case of inputting the scanning signal into the gate line corresponding to the first row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on G− subpixel disposed on the right of the B+ subpixel is 0V; the voltage of W− subpixel, disposed in the previous row of the G− subpixel (as shown by the subpixel in the fourth row) and connected with the same data line 201 together with the G− subpixel, is 0V; and no voltage jump (0V to 0V) occurs from the W− subpixel to the G− subpixel. Secondly, the third switch is switched off and the fourth switch is switched on. At this point, the first data terminal 321 or the second data terminal 322 inputs the data signals into the data line 201 corresponding to the fourth column of subpixels in each subpixel group 100 through the fourth switch, and the voltage on R− subpixel is −10V. Thirdly, the fourth switch is switched off and the second switch is switched on. The first data terminal 321 or the second data terminal 322 inputs the data signals into the data line 201 corresponding to the second column of subpixels in each subpixel group 100 through the second switch, and the voltage on the B+ subpixel is 10V. Then, the second switch is switched off and the first switch is switched on. At this point, the B+ subpixel is in the floating state; the first data terminal 321 or the second data terminal 322 inputs the data signals into the data line 201 corresponding to the first column of subpixels in each subpixel group 100 through the first switch; the voltage on W− subpixel is 0V; the voltage on G− subpixel, disposed in the previous row of the W− subpixel (as shown by the subpixel in the fourth row) and connected with the same data line 201 together with the W− subpixel, is 0V; and no voltage jump (from 0V to 0V) occurs from the G− subpixel to the W− subpixel.

In the above process, as no voltage jump occurs, even the B+ subpixel is in the floating state, the brightness of the B+ subpixel will not be affected. That is, in the process of displaying the mixed color image of red and blue, the brightness of the B+ subpixel is the preset brightness.

For example, for displaying B+ subpixel in the second row in the process of displaying the mixed color image of blue and red as an example, in the case of inputting the scanning signal into gate line corresponding to the second row of subpixels, firstly, the third switch is switched on. At this point, the first data terminal 321 or the second data terminal 322 inputs the data signals into the data line 201 corresponding to the third column of subpixels in each subpixel group 100 through the third switch; the voltage on W− subpixel disposed on the left of the B+ subpixel is 0V; the voltage on G− subpixel, disposed in the previous row of the W− subpixel (as shown by the subpixel in the first row) and connected with the same data line 201 together with the W− subpixel, is 0V; and no voltage jump (0V to 0V) occurs from the G− subpixel to the W− subpixel. Secondly, the third switch is switched off and the second switch is switched on. At this point, the first data terminal 321 or the second data terminal 322 inputs the data signal into the data line 201 corresponding to the second column of subpixels in each subpixel group 100 through the second switch, and the voltage on R+ subpixel is 10V. Thirdly, the second switch is switched off and the fourth switch is switched on. The first data terminal 321 or the second data terminal 322 inputs the data signals into the data line 201 corresponding to the fourth column of subpixels in each subpixel group 100 through the fourth switch, and the voltage on the B+ subpixel is 10V. Then, the fourth switch is switched off and the first switch is switched on. At this point, the B+ subpixel is in the floating state; the first data terminal 321 or the second data terminal 322 inputs the data signals into the data line 201 corresponding to the first column of subpixels in each subpixel group 100 through the first switch; the voltage on G+ subpixel is 0V; the voltage of W+ subpixel, disposed in the previous row of the G+ subpixel (as shown by the subpixel in the first row) and connected with the same data line 201 together with the G+ subpixel, is 0V; and no voltage jump (from 0V to 0V) occurs from the W+ subpixel to the G+ subpixel.

In the above process, as no voltage jump occurs, even the B+ subpixel is in the floating state, the brightness of the B+ subpixel will not be affected. That is to say, in the process of displaying the mixed color image of red and blue, the brightness of the B+ subpixel is the preset brightness.

In the case of inputting the data signals into the data lines 201 connected with the odd rows of subpixels according to the sequence of sequentially switching on the third switch, the fourth switch, the second switch and the first switch; and inputting the data signals into the data lines 201 connected with the even rows of subpixels according to the sequence of sequentially switching on the third switch, the second switch, the fourth switch, and the first switch, no transverse bright and dark stripe will appear in the embodiment of the present disclosure.

An embodiment of the present disclosure also provides a method of driving the display panel provided by any foregoing embodiment. The steps refer to the above description, and no further description will be given here.

An embodiment of the present disclosure also provides a display device, For example, the display device can be any product or component with display function, such as a liquid crystal panel, an OLED panel, electronic paper, a mobile phone, a tablet computer, a television, a display, a notebook computer, a digital photo frame or a navigator.

The foregoing is only the exemplary embodiments of the present disclosure, and the scope of the present disclosure is not limited thereto. A person of ordinary skill in the art can make various changes and modifications without departing from the present disclosure, and such changes and modifications shall fall into the scope of the present disclosure.

What is claimed is:

1. An array substrate, comprising a plurality of subpixels arranged in an array, a plurality of data lines, and a plurality of switches, wherein the plurality of subpixels comprise subpixels of a first color, subpixels of a second color, subpixels of a third color, and subpixels of a fourth color, in odd rows of subpixels, the subpixels of the first color, the subpixels of the second color, the subpixels of the third color, and the subpixels of the fourth color are sequentially arranged;

in even rows of subpixels, the subpixels of the third color, the subpixels of the fourth color, the subpixels of the first color, and the subpixels of the second color are sequentially arranged; and the subpixels of the first color are white subpixels, the subpixels of the second color are blue subpixels; the subpixels of the third color are green subpixels, and the subpixels of the fourth color are red subpixels, the plurality of subpixels are divided into a plurality of subpixel groups, each subpixel group comprises four adjacent columns of subpixels, each column of subpixels only belong to one subpixel group;

the plurality of switches comprise a plurality of first switches, a plurality of second switches, a plurality of third switches, and a plurality of fourth switches;

in each subpixel group, a source electrode of the first switch is electrically connected with the data line corresponding to the first column of subpixels, a gate electrode of the first switch is electrically connected with a first switch control line, a source electrode of the second switch is electrically connected with the data line corresponding to the second column of subpixels, a gate electrode of the second switch is electrically connected with a second switch control line, a source electrode of the third switch is electrically connected with the data line corresponding to the third column of subpixels, a gate electrode of the third switch is electrically connected with a third switch control line, a source electrode of the fourth switch is electrically connected with the data line corresponding to the fourth column of subpixels, and a gate electrode of the fourth switch is electrically connected with a fourth switch control line;

the array substrate further comprises first data terminals and second data terminals, wherein the first data terminals and the second data terminals are electrically connected with drain electrodes of the switches, respectively;

the subpixel groups comprise a first subpixel group and a second subpixel group; the subpixel group in the odd column is the first subpixel group, and the subpixel group in the even column is the second subpixel group;

the first data terminal is configured to input first data signals into data lines corresponding to odd columns of subpixels in the first subpixel group and even columns of subpixels in the second subpixel group; or the second data terminal is configured to input second data signals into data lines corresponding to even columns of subpixels in the first subpixel group and odd columns of subpixels in the second subpixel group; and the first data signals and the second data signals are data signals with opposite polarities.

2. The array substrate according to claim 1, further comprising a display area and a peripheral area at the periphery of the display area; the plurality of subpixels are disposed in the display area; and the switches, the first switch control line, the second switch control line, the third switch control line, the fourth switch control line, the first data terminals, and the second data terminals are disposed in the peripheral area.

3. The array substrate according to claim 1, wherein each subpixel comprises a thin-film transistor (TFT) and a pixel electrode; a drain electrode of the TFT is electrically connected with the pixel electrode; and the switch and the TFT are arranged in a same layer.

4. A display panel, comprising an array substrate, wherein the array substrate comprises:

a plurality of subpixels arranged in an array, a plurality of data lines, and a plurality of switches, wherein the plurality of subpixels comprise subpixels of a first color, subpixels of a second color, subpixels of a third color, and subpixels of a fourth color, in odd rows of subpixels, the subpixels of the first color, the subpixels of the second color, the subpixels of the third color, and the subpixels of the fourth color are sequentially arranged;

in even rows of subpixels, the subpixels of the third color, the subpixels of the fourth color, the subpixels of the first color, and the subpixels of the second color are sequentially arranged; and wherein the subpixels of the first color are white subpixels, the subpixels of the second color are blue subpixels, the subpixels of the third color are green subpixels, and the subpixels of the fourth color are red subpixels;

the plurality of subpixels are divided into a plurality of subpixel groups, each subpixel group comprises four adjacent columns of subpixels, each column of subpixels only belongs to one subpixel group;

the plurality of switches comprise a plurality of first switches, a plurality of second switches, a plurality of third switches, and a plurality of fourth switches;

in each subpixel group, a source electrode of the first switch is electrically connected with the data line corresponding to the first column of subpixels, a gate electrode of the first switch is electrically connected with a first switch control line, a source electrode of the second switch is electrically connected with the data line corresponding to the second column of subpixels, a gate electrode of the second switch is electrically connected with a second switch control line, a source electrode of the third switch is electrically connected with the data line corresponding to the third column of subpixels, a gate electrode of the third switch is electrically connected with a third switch control line, a source electrode of the fourth switch is electrically connected with the data line corresponding to the fourth column of subpixels, and a gate electrode of the fourth switch is electrically connected with a fourth switch control line;

the array substrate further comprises first data terminals and second data terminals, wherein the first data terminals and the second data terminals are electrically connected with drain electrodes of the switches, respectively;

the subpixel groups comprise a first subpixel group and a second subpixel group; the subpixel group in the odd column is the first subpixel group, and the subpixel group in the even column is the second subpixel group;

the first data terminal is configured to input first data signals into data lines corresponding to odd columns of subpixels in the first subpixel group and even columns of subpixels in the second subpixel group; or the second data terminal is configured to input second data signals into data lines corresponding to even columns of subpixels in the first subpixel group and odd columns of subpixels in the second subpixel group; and the first data signals and the second data signals are data signals with opposite polarities.

5. A method of driving the display panel according to claim 4, wherein the array substrate further comprises a plurality of gate lines; each row of subpixels corresponds to and is connected with a gate line; and the driving method comprises:

when a preset image is displayed in the case of inputting scanning signals into the gate lines, inputting data signals into the plurality of data lines according to a preset sequence, so that brightness of the subpixels of the same color in any two adjacent rows of subpixels is the same during the preset image is displayed, wherein the preset image is an image displayed when at least inputting the data signals into data lines corresponding to subpixels of one color and at most inputting the data signals into data lines corresponding to subpixels of three colors.

6. The method for driving the display panel according to claim 5, wherein data signals inputted into data lines corresponding to odd columns of subpixels in each first subpixel group and even columns of subpixels in each second subpixel group are positive; and data signals inputted into data lines corresponding to even columns of subpixels in each first subpixel group and odd columns of subpixels in each second subpixel group are negative.

7. The method for driving the display panel according to claim 6, wherein in the case of inputting scanning signals into the gate lines corresponding to any row of subpixels, the preset sequence is: sequentially inputting data signals into data lines corresponding to the second column of subpixels, the first column of subpixels, the third column of subpixels, and the fourth column of subpixels in each subpixel group, and at a same time period, the data signals are inputted into only the data line corresponding to one column of subpixels in each subpixel group; or in the case of inputting scanning signals into the gate lines corresponding to any row of subpixels, the preset sequence is: sequentially inputting the data signals into data lines corresponding to the third column of subpixels, the second column of subpixels, the fourth column of subpixels, and the first column of subpixels in each subpixel group, and at a same time period, the data signals are inputted into only the data line corresponding to one column of subpixels in each subpixel group; or in the case of inputting scanning signals into the gate lines corresponding to odd rows of subpixels, the data signals are sequentially inputted into data lines corresponding to the second column of subpixels, the first column of subpixels, the third column of subpixels, and the fourth column of subpixels in each subpixel group; in the case of inputting scanning signals into the gate lines corresponding to even rows of subpixels, the data signals are sequentially inputted into data lines corresponding to the second column of subpixels, the third column of subpixels, the first column of subpixels, and the fourth column of subpixels in each subpixel group, and at a same time period, the data signals are inputted into only the data line corresponding to one column of subpixels in each subpixel group; or in the case of inputting scanning signals into the gate lines corresponding to odd rows of subpixels, the data signals are sequentially inputted into data lines corresponding to the second column of subpixels, the fourth column of subpixels, the third column of subpixels, and the first column of subpixels in each subpixel group; and in the case of inputting scanning signals into the gate lines corresponding to even rows of subpixels, the data signals are sequentially inputted into data lines corresponding to the second column of subpixels, the third column of subpixels, the fourth column of subpixels, and the first column of subpixels in each subpixel group, and at a same time period, the data signals are inputted into only the data line corresponding to one column of subpixels in each subpixel group.

8. A display device, comprising a display panel, wherein the display panel comprises an array substrate, and wherein the array substrate comprises:

a plurality of subpixels arranged in an array, a plurality of data lines, and a plurality of switches, wherein the plurality of subpixels comprise subpixels of a first color, subpixels of a second color, subpixels of a third color, and subpixels of a fourth color, in odd rows of subpixels, the subpixels of the first color, the subpixels of the second color, the subpixels of the third color, and the subpixels of the fourth color are sequentially arranged; and in even rows of subpixels, the subpixels of the third color, the subpixels of the fourth color, the subpixels of the first color, and the subpixels of the second color are sequentially arranged;

wherein the subpixels of the first color are white subpixels, the subpixels of the second color are blue subpixels, the subpixels of the third color are green subpixels, and the subpixels of the fourth color are red subpixels;

the plurality of subpixels are divided into a plurality of subpixel groups, each subpixel group comprises four adjacent columns of subpixels, each column of subpixels only belong to one subpixel group;

the plurality of switches comprise a plurality of first switches, a plurality of second switches, a plurality of third switches, and a plurality of fourth switches;

in each subpixel group, a source electrode of the first switch is electrically connected with the data line corresponding to the first column of subpixels, a gate electrode of the first switch is electrically connected with a first switch control line, a source electrode of the second switch is electrically connected with the data line corresponding to the second column of subpixels, a gate electrode of the second switch is electrically connected with a second switch control line, a source electrode of the third switch is electrically connected with the data line corresponding to the third column of subpixels, a gate electrode of the third switch is electrically connected with a third switch control line, a source electrode of the fourth switch is electrically connected with the data line corresponding to the fourth column of subpixels, and a gate electrode of the fourth switch is electrically connected with a fourth switch control line;

the array substrate further comprises first data terminals and second data terminals, wherein the first data terminals and the second data terminals are electrically connected with drain electrodes of the switches, respectively;

the subpixel groups comprise a first subpixel group and a second subpixel group; the subpixel group in the odd column is the first subpixel group, and the subpixel group in the even column is the second subpixel group;

the first data terminal is configured to input first data signals into data lines corresponding to odd columns of subpixels in the first subpixel group and even columns of subpixels in the second subpixel group; or the second data terminal is configured to input second data signals into data lines corresponding to even columns of subpixels in the first subpixel group and odd columns of subpixels in the second subpixel group; and the first data signals and the second data signals are data signals with opposite polarities.

9. A method of driving the display device according to claim 8, wherein the array substrate further comprises a plurality of gate lines; each row of subpixels corresponds to and is connected with a gate line; and the driving method comprises:

when a preset image is displayed in the case of inputting scanning signals into the gate lines, inputting data signals into the plurality of data lines according to a preset sequence, so that brightness of the subpixels of the same color in any two adjacent rows of subpixels is the same during the preset image is displayed, wherein the preset image is an image displayed when at least inputting the data signals into data lines corresponding to subpixels of one color and at most inputting the data signals into data lines corresponding to subpixels of three colors.

10. The method of driving the display device according to claim 9, wherein data signals inputted into data lines corresponding to odd columns of subpixels in each first subpixel group and even columns of subpixels in each second subpixel group are positive; and data signals inputted into data lines corresponding to even columns of subpixels in each first subpixel group and odd columns of subpixels in each second subpixel group are negative.

11. The method of driving the display device according to claim 10, wherein in the case of inputting scanning signals into the gate lines corresponding to any row of subpixels, the preset sequence is: sequentially inputting data signals into data lines corresponding to the second column of subpixels, the first column of subpixels, the third column of subpixels, and the fourth column of subpixels in each subpixel group, and at a same time period, the data signals are inputted into only the data line corresponding to one column of subpixels in each subpixel group.

12. The method of driving the display device according to claim 10, wherein in the case of inputting scanning signals into the gate lines corresponding to any row of subpixels, the preset sequence is: sequentially inputting the data signals into data lines corresponding to the third column of subpixels, the second column of subpixels, the fourth column of subpixels, and the first column of subpixels in each subpixel group, and at a same time period, the data signals are inputted into only the data line corresponding to one column of subpixels in each subpixel group.

13. The method of driving the display device according to claim 10, wherein in the case of inputting scanning signals into the gate lines corresponding to odd rows of subpixels, the data signals are sequentially inputted into data lines corresponding to the second column of subpixels, the first column of subpixels, the third column of subpixels, and the fourth column of subpixels in each subpixel group; in the case of inputting scanning signals into the gate lines corresponding to even rows of subpixels, the data signals are sequentially inputted into data lines corresponding to the second column of subpixels, the third column of subpixels, the first column of subpixels, and the fourth column of subpixels in each subpixel group, and at a same time period, the data signals are inputted into only the data line corresponding to one column of subpixels in each subpixel group.

14. The method of driving the display device according to claim 10, wherein in the case of inputting scanning signals into the gate lines corresponding to odd rows of subpixels, the data signals are sequentially inputted into data lines corresponding to the second column of subpixels, the fourth column of subpixels, the third column of subpixels, and the first column of subpixels in each subpixel group; and in the case of inputting scanning signals into the gate lines corresponding to even rows of subpixels, the data signals are sequentially inputted into data lines corresponding to the second column of subpixels, the third column of subpixels, the fourth column of subpixels, and the first column of subpixels in each subpixel group, and at a same time period, the data signals are inputted into only the data line corresponding to one column of subpixels in each subpixel group.

* * * * *